US007828465B2

(12) United States Patent
Roberge et al.

(10) Patent No.: US 7,828,465 B2
(45) Date of Patent: Nov. 9, 2010

(54) LED-BASED FIXTURES AND RELATED METHODS FOR THERMAL MANAGEMENT

(75) Inventors: Brian Roberge, Franklin, MA (US); Ron Roberts, Medford, MA (US); Igor Shikh, Newton, MA (US); Ihor Lys, Milton, MA (US); Brad Koerner, Boston, MA (US); Tomas Mollnow, Somerville, MA (US)

(73) Assignee: Koninlijke Philips Electronis N.V., Eindhoven (NL)

( * ) Notice: Subject to any disclaimer, the term of this patent is extended or adjusted under 35 U.S.C. 154(b) by 273 days.

(21) Appl. No.: 12/114,500

(22) Filed: May 2, 2008

(65) Prior Publication Data

US 2008/0285271 A1 Nov. 20, 2008

Related U.S. Application Data

(60) Provisional application No. 60/916,053, filed on May 4, 2007, provisional application No. 60/916,496, filed on May 7, 2007, provisional application No. 60/984,855, filed on Nov. 2, 2007.

(51) Int. Cl.
*F21V 29/00* (2006.01)

(52) U.S. Cl. ..... 362/294; 362/218; 362/373; 362/147

(58) Field of Classification Search ..... 362/147, 362/294, 373, 218
See application file for complete search history.

(56) References Cited

U.S. PATENT DOCUMENTS

| | | | | |
|---|---|---|---|---|
| 5,857,767 | A * | 1/1999 | Hochstein | 362/294 |
| 7,329,033 | B2 * | 2/2008 | Glovatsky et al. | 362/547 |
| 7,427,152 | B2 * | 9/2008 | Erion et al. | 362/547 |
| 7,478,932 | B2 * | 1/2009 | Chinniah et al. | 362/507 |
| 7,593,229 | B2 * | 9/2009 | Shuy | 361/705 |
| 7,651,253 | B2 * | 1/2010 | Shuy | 362/547 |
| 2008/0285265 | A1 * | 11/2008 | Boissevain | 362/218 |

* cited by examiner

*Primary Examiner*—Ali Alavi

(57) ABSTRACT

LED-based lighting fixtures suitable for general illumination in surface-mount or suspended installations, in which heat dissipation properties of the fixtures are significantly improved by decreasing thermal resistance between LED junctions and the ambient air. In various examples, improved heat dissipation is accomplished by increasing a surface area of one or more heat-dissipating elements proximate a trajectory of air flow through the fixture. In one aspect, various structural components of the fixtures are particularly configured to create and maintain a "chimney effect" within the fixture, resulting in a high air-flow rate, natural convection cooling system capable of efficiently dissipating the waste heat from the fixture without active cooling.

23 Claims, 14 Drawing Sheets

LED-BASED FIXTURES AND RELATED METHODS FOR THERMAL MANAGEMENT

CROSS-REFERENCES TO RELATED APPLICATIONS

This application claims the benefit, under 35 U.S.C. §119 (e), of the following U.S. Provisional Applications; Ser. No. 60/916,053, filed on May 4, 2007, entitled "LED-based Fixtures and Related Methods for Thermal Management;" Ser. No. 60/984,855, filed Nov. 2, 2007, entitled "LED-based Fixtures and Related Methods for Thermal Management;" and Ser. No. 60/916,496, filed May 7, 2007, entitled "Power Control Methods and Apparatus." Each of these applications is hereby incorporated herein by reference.

BACKGROUND

The advent of digital lighting technologies, i.e. illumination based on semiconductor light sources, such as light-emitting diodes (LEDs), offers a viable alternative to traditional fluorescent, HID, and incandescent lamps. Functional advantages and benefits of LEDs include high energy conversion and optical efficiency, robustness, lower operating costs, and many others. For example, LEDs are particularly suitable for applications requiring small or low-profile light fixtures. The LEDs' smaller size, long operating life, low energy consumption, and durability make them a great choice when space is at a premium.

A "downlight" is a light fixture that is installed into a hollow opening in a ceiling and often referred to as a "recessed light" or "can light." When installed, it appears to concentrate light in a downward direction from the ceiling as a broad floodlight or narrow spotlight. Generally, there are two parts to recessed lights, the trim and housing. The trim is the visible portion of the light and includes the decorative lining around the edge of the light. The housing is the fixture itself that is installed inside the ceiling and contains the light socket.

An alternative to recessed lights is a surface-mount or suspended downlight, combining the functionality of the latter with flexibility and ease of installation over conventional junction boxes, particularly where disposal of the recessed light housing in the ceiling is impractical. In that regard, architects, engineers and lighting designers are often under considerable pressure to use low-profile, shallow-depth fixtures. Fundamentally, floor-to-floor heights are limited by developers looking to maximize their floor-to-area ratio; yet designers want to maximize the volume of the space by including the tallest ceilings possible. This contradiction sets up a conflict between various utilities, including lighting, that are competing for the limited recess depth found between the finished ceiling and the structural slab above.

Designers have also shunned most surface-mounted general-illumination solutions; the size of the primary light sources and ballasts, along with required optics and glare shielding techniques, quickly makes the fixtures too large to be aesthetically acceptable to most designers. Also, the compromises made to achieve low profile mounting heights in fixtures with traditional light sources typically negatively impact overall fixture efficacy. In fact, total fixture efficacy for many surface mounted compact fluorescent units averages only 30 lm/w.

A further deficiency with conventional downlights is that their large size can preclude their use for emergency lighting. That is, the addition of a backup power supply within the conventional fixture would make the fixture too large to be aesthetically acceptable or to fit within the allotted ceiling space. In conventional lighting schemes, only a selected few, if any, of the general illumination lights in an illuminated space may be provided with back-up power. Alternatively, a completely separate lighting system must be implemented for emergency lighting needs, thereby adding costs and space requirements.

Thus, it is desirable to provide a downlight fixture employing LED-based light sources that addresses a number of disadvantages of known LED illumination devices, particularly those associated with thermal management, light output, and ease of installation. Accordingly, one object of the invention disclosed herein is to provide a shallow surface-mount fixture—as shallow as 1"-2" overall height—to alleviate the undesirable constraints of shallow recess depths for many designers; in fact, it could help many projects reclaim up to 6" of ceiling height. Additionally, it would offer an elegant solution to projects with no recess cavity at all (mounting directly to concrete slabs). Another object is to achieve an overall fixture efficacy of about 30 lm/w or better in order to set various implementations of this invention on an equal plane with fluorescent sources yet at output levels normally associated with incandescent fixtures, thus setting this fixture up well for environments with low ambient light levels.

Additionally, maintaining a proper junction temperature is an important component to developing an efficient lighting system, as the LEDs perform with a higher efficacy when run at cooler temperatures. The use of active cooling via fans and other mechanical air moving systems, however, is typically discouraged in the general lighting industry primarily due to its inherent noise, cost and high maintenance needs. Thus, it is desirable to achieve air flow rates comparable to that of an actively cooled system without the noise, cost or moving parts, while minimizing the space requirements of the cooling system.

SUMMARY

In view of the foregoing, various embodiments of the invention disclosed herein generally relate to lighting fixtures employing LED-based light sources that are suitable for general illumination in surface-mount or suspended installations. For example, one embodiment is directed to a downlight LED-based lighting fixture, having a modular configuration such that its various components, including a bezel cover, lens, LED module, and power/control module are easily accessible for repair or replacement. Other aspects of the present invention focus on improving heat dissipation properties of such a fixture by optimizing its surface area and decreasing thermal resistance between an LED junction and the ambient air. In contrast to conventional naturally-cooled heat sink designs relying solely on considerations of form factor, surface area, and mass to dissipate a generated thermal load, in its various aspects and particular implementations, embodiments of the present invention additionally contemplate creating and maintaining a "chimney effect" within the fixture. The resulting high flow rate, natural convection cooling system is capable of efficiently dissipating the waste heat from an LED lighting module without active cooling.

Various inventive techniques for enhancing the air flow through a heat sink as disclosed herein can be used with different kinds of LED-based lighting fixtures or luminaries. It can be implemented with particular efficiency for the fixtures configured for projecting light unidirectionally, for example, downward. One embodiment employing these concepts focuses on a low-profile downlight fixture for monochromatic (e.g., white light) illumination, capitalizing on the low profile of LED lighting modules to create a surface-mounted fixture thinner than any other fixture utilizing conventional light sources. The fixture also capitalizes upon the directionality and optic capabilities of LEDs to create a total fixture efficacy that matches or surpasses even fluorescent sources. A unique thermal venting design according to the inventive concepts disclosed herein maintains appropriate thermal dissipation while creating a "clean," minimalist, contemporary appearance.

In some inventive embodiments, the heat sink is configured such that most of its heat-dissipating surface area is positioned in direct contact with the airflow created by the "chimney effect." In these implementations, the overall weight and profile of the fixture is minimized while achieving significantly increased levels of heat dissipation and improving design flexibility. For example, the design of the trim or housing can range from angular to sleek. In some applications, where the reduced profile is not a critical consideration, the downlight fixture can retain a conventional overall form factor or dimensions while housing additional components, such as a back-up power supply or battery in a space available within the fixture because of the reduced volume of the heat sink and/or compact size of the LED and the power/control modules.

In addition to a downlight fixture, another exemplary implementation of the inventive concepts disclosed herein includes a hanging spot pendant lighting fixture, particularly suitable for the general ambient illumination of a small, intimate environment, such as a dining, kitchen island, or conference room setting. Possible uses for such for such a lighting fixture include, but are not limited to, task lighting, low ambient mood lighting, accent lighting and other purposes. Yet another exemplary implementation includes a track head fixture suitable for general illumination and accent lighting of objects and architectural features and configured for installation with a conventional open architecture track.

In sum, one embodiment of the present invention is directed to a lighting apparatus, comprising at least one LED light source a heat sink thermally coupled to the at least one LED light source, a first housing portion mechanically coupled to the heat sink, and a second housing portion mechanically coupled to the heat sink. The first housing portion is disposed with respect to the heat sink so as to form a first air gap, a second air gap and an air channel through the lighting apparatus. When the heat sink transfers heat from the at least one LED light source during operation of the at least one LED light source so as to create heated air surrounding the heat sink, ambient air is drawn through the first air gap and the heated air is exhausted through the second air gap so as to create an air flow trajectory in the air channel from the first air gap to the second air gap.

Another embodiment is directed to a lighting fixture, comprising a bezel plate including at least one LED for generating the light, and a heat dissipating frame mechanically coupled to the bezel plate and including a mounting portion positioned within the opening of the bezel plate, the LED module being disposed on the mounting portion of the heat dissipating frame. The bezel plate and the heat dissipating frame are positioned with respect to each other so as to form an air channel through the fixture, such that an air flow is created in the air channel via a chimney effect in response to heat generated by the LED module.

Yet another embodiment is directed to a method for cooling an LED-based lighting fixture, comprising drawing ambient air into the lighting fixture through a first air gap, flowing the ambient air through an internal air channel of the lighting fixture, and exhausting heated air from the lighting fixture through a second air gap, without using a fan and via a chimney effect in response to heat generated by at least one LED of the LED-based lighting fixture.

RELEVANT TERMINOLOGY

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like.

In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

RELATED PATENTS AND PATENT APPLICATIONS

The following patents and patent applications, relevant to the present disclosure, and any inventive concepts contained therein, are hereby incorporated herein by reference:

- U.S. Pat. No. 6,016,038, issued Jan. 18, 2000, entitled "Multicolored LED Lighting Method and Apparatus;"
- U.S. Pat. No. 6,211,626, issued Apr. 3, 2001, entitled "Illumination Components;"
- U.S. Pat. No. 6,975,079, issued Dec. 13, 2005, entitled "Systems and Methods for Controlling Illumination Sources;"
- U.S. Pat. No. 7,014,336, issued Mar. 21, 2006, entitled "Systems and Methods for Generating and Modulating Illumination Conditions;"
- U.S. Pat. No. 7,038,399, issued May 2, 2006, entitled "Methods and Apparatus for Providing Power to Lighting Devices;"
- U.S. Pat. No. 7,233,115, issued Jun. 19, 2007, entitled "LED-Based Lighting Network Power Control Methods and Apparatus;"
- U.S. Pat. No. 7,256,554, issued Aug. 14, 2007, entitled "LED Power Control Methods and Apparatus;"
- U.S. Patent Application Publication No. 2007-0115665, filed May 24, 2007, entitled "Methods and Apparatus for Generating and Modulating White Light Illumination Conditions;"
- U.S. Provisional Application Ser. No. 60/916,053, filed May 4, 2007, entitled "LED-Based Fixtures and Related Methods for Thermal Management;" and
- U.S. Provisional Application Ser. No. 60/916,496, filed May 7, 2007, entitled "Power Control Methods and Apparatus."

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Various embodiments of the present invention and related inventive concepts are described below, including certain embodiments relating particularly to LED-based light sources. It should be appreciated, however, that the present disclosure is not limited to any particular manner of implementation, and that the various embodiments discussed explicitly herein are primarily for purposes of illustration. For example, the various concepts disclosed herein may be suitably implemented in fixtures having a variety of form factors, such as a track head fixtures and pendant fixtures, and involving LED-based light sources.

Figure 1:
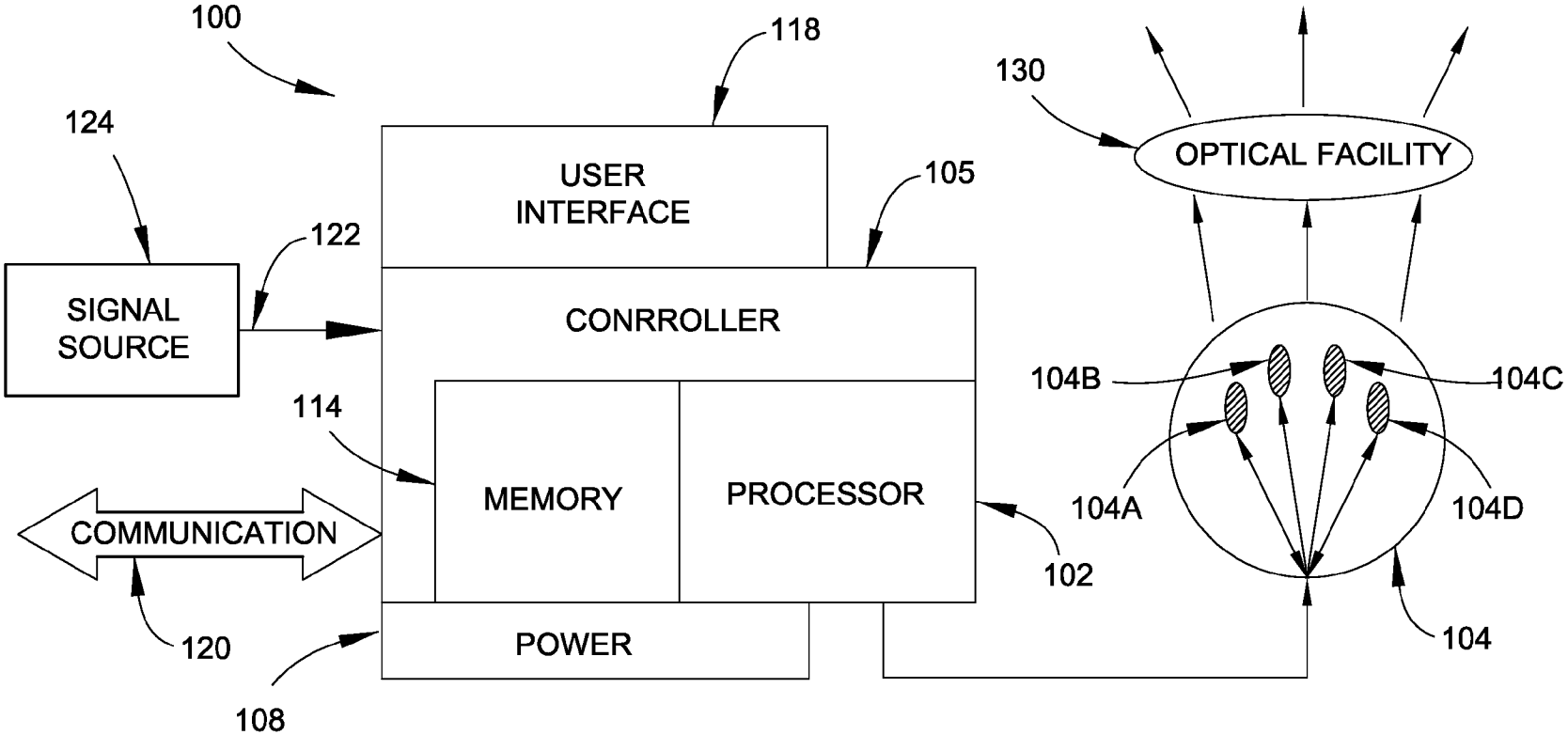
FIG. 1 is a diagram illustrating a controlled LED-based light source suitable for use with a downlight fixture disclosed herein.

FIG. 1 illustrates one example of a lighting unit 100 that is suitable for use with any of the fixtures described herein. Some general examples of LED-based lighting units similar to those that are described below in connection with FIG. 1 may be found, for example, in U.S. Pat. No. 6,016,038, issued Jan. 18, 2000 to Mueller et al., entitled "Multicolored LED Lighting Method and Apparatus," and U.S. Pat. No. 6,211,626, issued Apr. 3, 2001 to Lys et al, entitled "Illumination Components," which patents are both hereby incorporated herein by reference.

In various implementations, the lighting unit 100 shown in FIG. 1 may be used alone or together with other similar lighting units in a system of lighting units (e.g., as discussed further below in connection with FIG. 2). Used alone or in combination with other lighting units, the lighting unit 100 may be employed in a variety of applications including, but not limited to, direct-view or indirect-view interior or exterior space (e.g., architectural) lighting and illumination in general, direct or indirect illumination of objects or spaces, theatrical or other entertainment-based/special effects lighting, decorative lighting, safety-oriented lighting, vehicular lighting, lighting associated with, or illumination of, displays and/or merchandise (e.g. for advertising and/or in retail/consumer environments), combined lighting or illumination and communication systems, etc., as well as for various indication, display and information purposes.

Additionally, one or more lighting units similar to that described in connection with FIG. 1 may be implemented in a variety of products including, but not limited to, various forms of light modules or bulbs having various shapes and electrical/mechanical coupling arrangements (including replacement or "retrofit" modules or bulbs adapted for use in conventional sockets or fixtures), as well as a variety of consumer and/or household products (e.g., night lights, toys, games or game components, entertainment components or systems, utensils, appliances, kitchen aids, cleaning products, etc.) and architectural components (e.g., lighted panels for walls, floors, ceilings, lighted trim and ornamentation components, etc.).

The lighting unit 100 shown in FIG. 1 may include one or more light sources 104A, 104B, 104C, and 104D (shown collectively as 104), wherein one or more of the light sources may be an LED-based light source that includes one or more LEDs. Any two or more of the light sources may be adapted to generate radiation of different colors (e.g. red, green, blue); in this respect, as discussed above, each of the different color light sources generates a different source spectrum that constitutes a different "channel" of a "multi-channel" lighting unit. Although FIG. 1 shows four light sources 104A, 104B, 104C, and 104D, it should be appreciated that the lighting unit is not limited in this respect, as different numbers and various types of light sources (all LED-based light sources, LED-based and non-LED-based light sources in combination, etc.) adapted to generate radiation of a variety of different colors, including essentially white light, may be employed in the lighting unit 100, as discussed further below.

Still referring to FIG. 1, the lighting unit 100 also may include a controller 105 that is configured to output one or more control signals to drive the light sources so as to generate various intensities of light from the light sources. For example, in one implementation, the controller 105 may be configured to output at least one control signal for each light source so as to independently control the intensity of light (e.g., radiant power in lumens) generated by each light source; alternatively, the controller 105 may be configured to output one or more control signals to collectively control a group of two or more light sources identically. Some examples of control signals that may be generated by the controller to control the light sources include, but are not limited to, pulse modulated signals, pulse width modulated signals (PWM), pulse amplitude modulated signals (PAM), pulse code modulated signals (PCM) analog control signals (e.g., current control signals, voltage control signals), combinations and/or modulations of the foregoing signals, or other control signals. In some implementations, particularly in connection with LED-based sources, one or more modulation techniques provide for variable control using a fixed current level applied to one or more LEDs, so as to mitigate potential undesirable or unpredictable variations in LED output that may arise if a variable LED drive current were employed. In other implementations, the controller 105 may control other dedicated circuitry (not shown in FIG. 1) which in turn controls the light sources so as to vary their respective intensities.

In general, the intensity (radiant output power) of radiation generated by the one or more light sources is proportional to the average power delivered to the light source(s) over a given time period. Accordingly, one technique for varying the intensity of radiation generated by the one or more light sources involves modulating the power delivered to (i.e., the operating power of) the light source(s). For some types of light sources, including LED-based sources, this may be accomplished effectively using a pulse width modulation (PWM) technique.

In one exemplary implementation of a PWM control technique, for each channel of a lighting unit a fixed predetermined voltage $V_{source}$ is applied periodically across a given light source constituting the channel. The application of the voltage $V_{source}$ may be accomplished via one or more switches, not shown in FIG. 1, controlled by the controller 105. While the voltage $V_{source}$ is applied across the light source, a predetermined fixed current $I_{source}$ (e.g., determined by a current regulator, also not shown in FIG. 1) is allowed to flow through the light source. Again, recall that an LED-based light source may include one or more LEDs, such that the voltage $V_{source}$ may be applied to a group of LEDs constituting the source, and the current $I_{source}$ may be drawn by the group of LEDs. The fixed voltage $V_{source}$ across the light source when energized, and the regulated current $P_{source}$ drawn by the light source when energized, determines the amount of instantaneous operating power $P_{source}$ of the light source ($P_{source}=V_{source}\cdot I_{source}$). As mentioned above, for LED-based light sources, using a regulated current mitigates potential undesirable or unpredictable variations in LED output that may arise if a variable LED drive current were employed.

According to the PWM technique, by periodically applying the voltage $V_{source}$ to the light source and varying the time the voltage is applied during a given on-off cycle, the average power delivered to the light source over time (the average operating power) may be modulated. In particular, the controller 105 may be configured to apply the voltage $V_{source}$ to a given light source in a pulsed fashion (e.g., by outputting a control signal that operates one or more switches to apply the voltage to the light source), preferably at a frequency that is greater than that capable of being detected by the human eye (e.g., greater than approximately 100 Hz). In this manner, an observer of the light generated by the light source does not perceive the discrete on-off cycles (commonly referred to as a "flicker effect"), but instead the integrating function of the eye perceives essentially continuous light generation. By adjusting the pulse width (i.e. on-time, or "duty cycle") of on-off cycles of the control signal, the controller varies the average amount of time the light source is energized in any given time period, and hence varies the average operating power of the light source. In this manner, the perceived brightness of the generated light from each channel in turn may be varied.

As discussed in greater detail below, the controller 105 may be configured to control each different light source channel of a multi-channel lighting unit at a predetermined average operating power to provide a corresponding radiant output power for the light generated by each channel. Alternatively, the controller 105 may receive instructions (e.g., "lighting commands") from a variety of origins, such as a user interface 118, a signal source 124, or one or more communication ports 120, that specify prescribed operating powers for one or more channels and, hence, corresponding radiant output powers for the light generated by the respective channels. By varying the prescribed operating powers for one or more channels (e.g., pursuant to different instructions or lighting commands), different perceived colors and brightness levels of light may be generated by the lighting unit.

In some implementations of the lighting unit 100, as mentioned above, one or more of the light sources 104A, 104B, 104C, and 104D shown in FIG. 1 may include a group of multiple LEDs or other types of light sources (e.g., various parallel and/or serial connections of LEDs or other types of light sources) that are controlled together by the controller 105. Additionally, it should be appreciated that one or more of the light sources may include one or more LEDs that are adapted to generate radiation having any of a variety of spectra (i.e., wavelengths or wavelength bands), including, but not limited to, various visible colors (including essentially white light), various color temperatures of white light, ultraviolet, or infrared. LEDs having a variety of spectral bandwidths (e.g., narrow band, broader band) may be employed in various implementations of the lighting unit 100.

The lighting unit 100 may be constructed and arranged to produce a wide range of variable color radiation. For example, in one implementation, the lighting unit 100 may be particularly arranged such that controllable variable intensity (i.e., variable radiant power) light generated by two or more of the light sources combines to produce a mixed colored light (including essentially white light having a variety of color temperatures). In particular, the color (or color temperature) of the mixed colored light may be varied by varying one or more of the respective intensities (output radiant power) of the light sources (e.g., in response to one or more control signals output by the controller 105). Furthermore, the controller 105 may be particularly configured to provide control signals to one or more of the light sources so as to generate a variety of static or time-varying (dynamic) multi-color (or multi-color temperature) lighting effects. To this end, the controller may include a processor 102 (e.g., a microprocessor) programmed to provide such control signals to one or more of the light sources. In various implementations, the processor 102 may be programmed to provide such control signals autonomously, in response to lighting commands, or in response to various user or signal inputs.

Thus, the lighting unit 100 may include a wide variety of colors of LEDs in various combinations, including two or more of red, green, and blue LEDs to produce a color mix, as well as one or more other LEDs to create varying colors and color temperatures of white light. For example, red, green and blue can be mixed with amber, white, UV, orange, IR or other colors of LEDs. Additionally, multiple white LEDs having different color temperatures (e.g., one or more first white LEDs that generate a first spectrum corresponding to a first color temperature, and one or more second white LEDs that generate a second spectrum corresponding to a second color temperature different than the first color temperature) may be employed, in an all-white LED lighting unit or in combination with other colors of LEDs. Such combinations of differently colored LEDs and/or different color temperature white LEDs in the lighting unit 100 can facilitate accurate reproduction of a host of desirable spectrums of lighting conditions, examples of which include, but are not limited to, a variety of outside daylight equivalents at different times of the day, various interior lighting conditions, lighting conditions to simulate a complex multicolored background, and the like. Other desirable lighting conditions can be created by removing particular pieces of spectrum that may be specifically absorbed, attenuated or reflected in certain environments. Water, for example tends to absorb and attenuate most non-blue and non-green colors of light, so underwater applications may benefit from lighting conditions that are tailored to emphasize or attenuate some spectral elements relative to others.

As shown in FIG. 1, the lighting unit 100 also may include a memory 114 to store various data. For example, the memory 114 may be employed to store one or more lighting commands or programs for execution by the processor 102 (e.g., to generate one or more control signals for the light sources), as well as various types of data useful for generating variable color radiation (e.g., calibration information, discussed further below). The memory 114 also may store one or more particular identifiers (e.g., a serial number, an address, etc.) that may be used either locally or on a system level to identify the lighting unit 100. In various embodiments, such identifiers may be pre-programmed by a manufacturer, for example, and may be either alterable or non-alterable thereafter (e.g., via some type of user interface located on the lighting unit, via one or more data or control signals received by the lighting unit, etc.). Alternatively, such identifiers may be determined at the time of initial use of the lighting unit in the field, and again may be alterable or non-alterable thereafter.

One issue that may arise in connection with controlling multiple light sources in the lighting unit 100 of FIG. 1, and controlling multiple lighting units 100 in a lighting system (e.g., as discussed below in connection with FIG. 2), relates to potentially perceptible differences in light output between substantially similar light sources. For example, given two virtually identical light sources being driven by respective identical control signals, the actual intensity of light (e.g., radiant power in lumens) output by each light source may be measurably different. Such a difference in light output may be attributed to various factors including, for example, slight manufacturing differences between the light sources, normal wear and tear over time of the light sources that may differently alter the respective spectrums of the generated radiation, etc. For purposes of the present discussion, light sources for which a particular relationship between a control signal and resulting output radiant power are not known are referred to as "uncalibrated" light sources. The use of one or more uncalibrated light sources in the lighting unit 100 shown in FIG. 1 may result in generation of light having an unpredictable, or "uncalibrated," color or color temperature. For example, consider a first lighting unit including a first uncalibrated red light source and a first uncalibrated blue light source, each controlled in response to a corresponding lighting command having an adjustable parameter in a range of form zero to 255 (0-255), wherein the maximum value of 255 represents the maximum radiant power available (i.e., 100%) from the light source. For purposes of this example, if the red command is set to zero and the blue command is non-zero, blue light is generated, whereas if the blue command is set to zero and the red command is non-zero, red light is generated. However, if both commands are varied from non-zero values, a variety of perceptibly different colors may be produced (e.g., in this example, at very least, many different shades of purple are possible). In particular, perhaps a particular desired color (e.g., lavender) is given by a red command having a value of 125 and a blue command having a value of 200. Now consider a second lighting unit including a second uncalibrated red light source substantially similar to the first uncalibrated red light source of the first lighting unit, and a second uncalibrated blue light source substantially similar to the first uncalibrated blue light source of the first lighting unit. As discussed above, even if both of the uncalibrated red light sources are controlled in response to respective identical commands, the actual intensity of light (e.g., radiant power in lumens) output by each red light source may be measurably different. Similarly, even if both of the uncalibrated blue light sources are controlled in response to respective identical commands, the actual light output by each blue light source may be measurably different.

With the foregoing in mind, it should be appreciated that if multiple uncalibrated light sources are used in combination in lighting units to produce a mixed colored light as discussed above, the observed color (or color temperature) of light produced by different lighting units under identical control conditions may be perceivably different. Specifically, consider again the "lavender" example above; the "first lavender" produced by the first lighting unit with a red command having a value of 125 and a blue command having a value of 200 indeed may be perceivably different than a "second lavender" produced by the second lighting unit with a red command having a value of 125 and a blue command having a value of 200. More generally, the first and second lighting units generate uncalibrated colors by virtue of their uncalibrated light sources. Accordingly, in some implementations of the present invention, the lighting unit 100 includes calibration means to facilitate the generation of light having a calibrated (e.g., predictable, reproducible) color at any given time. In one aspect, the calibration means is configured to adjust (e.g., scale) the light output of at least some light sources of the lighting unit so as to compensate for perceptible differences between similar light sources used in different lighting units. For example, in one embodiment, the processor 102 if the lighting unit 100 is configured to control one or more of the light sources so as to output radiation at a calibrated intensity that substantially corresponds in a predetermined manner to a control signal for the light source(s). As a result of mixing radiation having different spectra and respective calibrated intensities, a calibrated color is produced. In one aspect of this embodiment, at least one calibration value for each light source is stored in the memory 114, and the processor is programmed to apply the respective calibration values to the control signals (commands) for the corresponding light sources so as to generate the calibrated intensities. One or more calibration values may be determined once (e.g., during a lighting unit manufacturing/testing phase) and stored in the memory 114 for use by the processor 102. In another aspect, the processor 102 may be configured to derive one or more calibration values dynamically (e.g. from time to time) with the aid of one or more photosensors, for example. In various embodiments, the photosensor(s) may be one or more external components coupled to the lighting unit, or alternatively may be integrated as part of the lighting unit itself. A photosensor is one example of a signal source that may be integrated or otherwise associated with the lighting unit 100, and monitored by the processor 102 in connection with the operation of the lighting unit. Other examples of such signal sources are discussed further below, in connection with the signal source 124 shown in FIG. 1. One exemplary method that may be implemented by the processor 102 to derive one or more calibration values includes applying a reference control signal to a light source (e.g., corresponding to maximum output radiant power), and measuring (e.g., via one or more photosensors) an intensity of radiation (e.g., radiant power falling on the photosensor) thus generated by the light source. The processor may be programmed to then make a comparison of the measured intensity and at least one reference value (e.g., representing an intensity that nominally would be expected in response to the reference control signal). Based on such a comparison, the processor may determine one or more calibration values (e.g., scaling factors) for the light source. In particular, the processor may derive a calibration value such that, when applied to the reference control signal, the light source outputs radiation having an intensity that corresponds to the reference value (i.e., an "expected" intensity, e.g., expected radiant power in lumens). In various aspects, one calibration value may be derived for an entire range of control signal/output intensities for a given light source. Alternatively, multiple calibration values may be derived for a given light source (i.e., a number of calibration value "samples" may be obtained) that are respectively applied over different control signal/output intensity ranges, to approximate a nonlinear calibration function in a piecewise linear manner.

Still referring to FIG. 1, the lighting unit 100 optionally may include one or more user interfaces 118 that are provided to facilitate any of a number of user-selectable settings or functions (e.g., generally controlling the light output of the lighting unit 100, changing and/or selecting various pre-programmed lighting effects to be generated by the lighting unit, changing and/or selecting various parameters of selected lighting effects, setting particular identifiers such as addresses or serial numbers for the lighting unit, etc.). In various embodiments, the communication between the user interface 118 and the lighting unit may be accomplished through wire or cable, or wireless transmission.

In one implementation, the controller 105 of the lighting unit monitors the user interface 118 and controls one or more of the light sources 104A, 104B, 104C and 104D based at least in part on a user's operation of the interface. For example, the controller 105 may be configured to respond to operation of the user interface by originating one or more control signals for controlling one or more of the light sources. Alternatively, the processor 102 may be configured to respond by selecting one or more pre-programmed control signals stored in memory, modifying control signals generated by executing a lighting program, selecting and executing a new lighting program from memory, or otherwise affecting the radiation generated by one or more of the light sources.

In particular, in one implementation, the user interface 118 may constitute one or more switches (e.g., a standard wall switch) that interrupt power to the controller 105. In one aspect of this implementation, the controller 105 is configured to monitor the power as controlled by the user interface, and in turn control one or more of the light sources based at least in part on duration of a power interruption caused by operation of the user interface. As discussed above, the controller may be particularly configured to respond to a predetermined duration of a power interruption by, for example, selecting one or more pre-programmed control signals stored in memory, modifying control signals generated by executing a lighting program, selecting and executing a new lighting program from memory, or otherwise affecting the radiation generated by one or more of the light sources.

FIG. 1 also illustrates that the lighting unit 100 may be configured to receive one or more signals 122 from one or more other signal sources 124. In one implementation, the controller 105 of the lighting unit may use the signal(s) 122, either alone or in combination with other control signals (e.g., signals generated by executing a lighting program, one or more outputs from a user interface, etc.), so as to control one or more of the light sources 104A, 104B, 104C and 104D in a manner similar to that discussed above in connection with the user interface.

Examples of the signal(s) 122 that may be received and processed by the controller 105 include, but are not limited to, one or more audio signals, video signals, power signals, various types of data signals, signals representing information obtained from a network (e.g., the Internet), signals representing one or more detectable/sensed conditions, signals from lighting units, signals consisting of modulated light, etc. In various implementations, the signal source(s) 124 may be located remotely from the lighting unit 100, or included as a component of the lighting unit. In one embodiment, a signal from one lighting unit 100 could be sent over a network to another lighting unit 100.

Some examples of a signal source 124 that may be employed in, or used in connection with, the lighting unit 100 of FIG. 1 include any of a variety of sensors or transducers that generate one or more signals 122 in response to some stimulus. Examples of such sensors include, but are not limited to, various types of environmental condition sensors, such as thermally sensitive (e.g., temperature, infrared) sensors, humidity sensors, motion sensors, photosensors/light sensors (e.g., photodiodes, sensors that are sensitive to one or more particular spectra of electromagnetic radiation such as spectroradiometers or spectrophotometers, etc.), various types of cameras, sound or vibration sensors or other pressure/force transducers (e.g., microphones, piezoelectric devices), and the like.

Additional examples of a signal source 124 include various metering/detection devices that monitor electrical signals or characteristics (e.g., voltage, current, power, resistance, capacitance, inductance, etc.) or chemical/biological characteristics (e.g., acidity, a presence of one or more particular chemical or biological agents, bacteria, etc.) and provide one or more signals 122 based on measured values of the signals or characteristics. Yet other examples of a signal source 124 include various types of scanners, image recognition systems, voice or other sound recognition systems, artificial intelligence and robotics systems, and the like. A signal source 124 could also be alighting unit 100, another controller or processor, or any one of many available signal generating devices, such as media players, MP3 players, computers, DVD players, CD players, television signal sources, camera signal sources, microphones, speakers, telephones, cellular phones, instant messenger devices, SMS devices, wireless devices, personal organizer devices, and many others.

In one embodiment, the lighting unit 100 shown in FIG. 1 also may include one or more optical elements or facilities 130 to optically process the radiation generated by the light sources 104A, 104B, 104C, and 104D. For example, one or more optical elements may be configured so as to change one or both of a spatial distribution and a propagation direction of the generated radiation. In particular, one or more optical elements may be configured to change a diffusion angle of the generated radiation. In one aspect of this embodiment, one or more optical elements 130 may be particularly configured to variably change one or both of a spatial distribution and a propagation direction of the generated radiation (e.g., in response to some electrical and/or mechanical stimulus). Examples of optical elements that may be included in the lighting unit 100 include, but are not limited to, reflective materials, refractive materials, translucent materials, filters, lenses, mirrors, and fiber optics. The optical element 130 also may include a phosphorescent material, luminescent material, or other material capable of responding to or interacting with the generated radiation.

As also shown in FIG. 1, the lighting unit 100 may include one or more communication ports 120 to facilitate coupling of the lighting unit 100 to any of a variety of other devices, including one or more other lighting units. For example, one or more communication ports 120 may facilitate coupling multiple lighting units together as a networked lighting system, in which at least some or all of the lighting units are addressable (e.g., have particular identifiers or addresses) and/or are responsive to particular data transported across the network. In another aspect, one or more communication ports 120 may be adapted to receive and/or transmit data through wired or wireless transmission. In one embodiment, information received through the communication port may at least in part relate to address information to be subsequently used by the lighting unit, and the lighting unit may be adapted to receive and then store the address information in the memory 114 (e.g., the lighting unit may be adapted to use the stored address as its address for use when receiving subsequent data via one or more communication ports).

In particular, in a networked lighting system environment, as discussed in greater detail further below (e.g., in connection with FIG. 2), as data is communicated via the network, the controller 105 of each lighting unit coupled to the network may be configured to be responsive to particular data (e.g., lighting control commands) that pertain to it (e.g., in some cases, as dictated by the respective identifiers of the networked lighting units). Once a given controller identifies particular data intended for it, it may read the data and, for example, change the lighting conditions produced by its light sources according to the received data (e.g., by generating appropriate control signals to the light sources). In one aspect, the memory 114 of each lighting unit coupled to the network may be loaded, for example, with a table of lighting control signals that correspond with data the processor 102 of the controller receives. Once the processor 102 receives data from the network, the processor may consult the table to select the control signals that correspond to the received data, and control the light sources of the lighting unit accordingly (e.g., using any one of a variety of analog or digital signal control techniques, including various pulse modulation techniques discussed above).

In one aspect of this embodiment, the processor 102 of a given lighting unit, whether or not coupled to a network, may be configured to interpret lighting instructions/data that are received in a DMX protocol (as discussed, for example, in U.S. Pat. Nos. 6,016,038 and 6,211,626), which is a lighting command protocol conventionally employed in the lighting industry for some programmable lighting applications. In the DMX protocol, lighting instructions are transmitted to a lighting unit as control data that is formatted into packets including 512 bytes of data, in which each data byte is constituted by 8-bits representing a digital value of between zero and 255. These 512 data bytes are preceded by a "start code" byte. An entire "packet" including 513 bytes (start code plus data) is transmitted serially at 250 kbit/s pursuant to RS-485 voltage levels and cabling practices, wherein the start of a packet is signified by a break of at least 88 microseconds.

In the DMX protocol, each data byte of the 512 bytes in a given packet is intended as a lighting command for a particular "channel" of a multi-channel lighting unit, wherein a digital value of zero indicates no radiant output power for a given channel of the lighting unit (i.e., channel off), and a digital value of 255 indicates full radiant output power (100% available power) for the given channel of the lighting unit (i.e., channel full on). For example, in one aspect, considering for the moment a three-channel lighting unit based on red, green and blue LEDs (i.e., and "R-G-B" lighting unit), a lighting in DMX protocol may specify each of a red channel command, a green channel command, and a blue channel command as eight-bit data (i.e., a data byte) representing a value from 0 to 255. The maximum value of 255 for any one of the color channels instructs the processor 102 to control the corresponding light source(s) to operate at maximum available power (i.e., 100%) for the channel, thereby generating the maximum available radiant power for that color (such a command structure for an R-G-B lighting unit commonly is referred to as 24-bit color control). Hence, a command of the format [R, G, B]=[255, 255, 255] would cause the lighting unit to generate maximum radiant power for each of red, green and blue light (thereby creating white light).

Thus, a given communication link employing the DMX protocol conventionally can support up to 512 different lighting unit channels. A given lighting unit designed to receive communications formatted in the DMX protocol generally is configured to respond to only one or more particular data bytes of the 512 bytes in the packet corresponding to the number of channels of the lighting unit (e.g., in the example of a three-channel lighting unit, three bytes are used by the lighting unit), and ignore the other bytes, based on a particular position of the desired data byte(s) in the overall sequence of the 512 data bytes in the packet. To this end, DMX-based lighting units may be equipped with an address selection mechanism that may be manually set by a user/installer to determine the particular position of the data byte(s) that the lighting unit responds to in a given DMX packet.

It should be appreciated, however, that lighting units suitable for purposes of the present disclosure are not limited to a DMX command format, as lighting units according to various embodiments may be configured to be responsive to other types of communication protocols/lighting command formats so as to control their respective light sources. In general, the processor 102 may be configured to respond to lighting commands in a variety of formats that express prescribed operating powers for each different channel of a multi-channel lighting unit according to some scale representing zero to maximum available operating power for each channel.

For example, in another embodiment, the processor 102 of a given lighting unit may be configured to interpret lighting instructions/data that are received in a conventional Ethernet protocol (or similar protocol based on Ethernet concepts). Ethernet is a well-known computer networking invention often employed for local area networks (LANs) that defined wiring and signaling requirements for interconnected devices forming the network, as well as frame formats and protocols for data transmitted over the network. Devices coupled to the network have respective unique addresses, and data for one or more addressable devices on the network is organized as packets. Each Ethernet packet includes a "header" that specifies a destination address (to where the packet is going) and a source address (from where the packet came), followed by a "payload" including several bytes of data (e.g., in Type II Ethernet frame protocol, the payload may be from 46 data bytes to 1500 data bytes). A packet concludes with an error correction code or "checksum." As with the DMX protocol discussed above, the payload of successive Ethernet packets destined for a given lighting unit configured to receive communications in an Ethernet protocol may include information that represents respective prescribed radiant powers for different available spectra of light (e.g., different color channels) capable of being generated by the lighting unit.

In yet another embodiment, the processor 102 of a given lighting unit may be configured to interpret lighting instructions/data that are received in a serial-based communication protocol as described, for example, in U.S. Pat. No. 6,777,891. In particular, according to one embodiment based on a serial-based communication protocol, multiple lighting units 100 are coupled together via their communication ports 120 to form a series connection of lighting units (e.g., a daisy-chain or ring topology), wherein each lighting unit has an input communication port and an output communication port. Lighting instructions/data transmitted to the lighting units are arranged sequentially based on a relative position in the series connection of each lighting unit. It should be appreciated that while a lighting network based on a series interconnection of lighting units is discussed particularly in connection with an embodiment employing a serial-based communication protocol, the disclosure is not limited in this respect, as other examples of lighting network topologies contemplated by the present disclosure are discussed further below in connection with FIG. 2.

In one embodiment employing a serial-based communication protocol, as the processor 102 of each lighting unit in the series connection receives data, it "strips off" or extracts one or more initial portions of the data sequence intended for it and transmits the remainder of the data sequence to the next lighting unit in the series connection. For example, again considering a serial interconnection of multiple three-channel (e.g., "R-G-B") lighting units, three-multi-bit values (one multi-bit value per channel) are extracted by each three-channel lighting unit from the received data sequence. Each lighting unit in the series connection in turn repeats this procedure, namely, stripping off or extracting one or more initial portions (multi-bit values) of a received data sequence and transmitting the remainder of the sequence. The initial portion of a data sequence stripped off in turn by each lighting unit may include respective prescribed radiant powers for different available spectra of light (e.g., different color channels) capable of being generated by the lighting unit. As discussed above in connection with the DMX protocol, in various implementations each multi-bit value per channel may be an 8-bit value, or other number of bits (e.g., 12, 16, 24, etc.) per channel, depending in part on a desired control resolution for each channel.

In yet another exemplary implementation of a serial-based communication protocol, rather than stripping off an initial portion of a received data sequence, a flag is associated with each portion of a data sequence representing data for multiple channels of a given lighting unit, and an entire data sequence for multiple lighting units is transmitted completely from lighting unit to lighting unit in the serial connection. As a lighting unit in the serial connection receives the data sequence, it looks for the first portion of the data sequence in which the flag indicates that a given portion (representing one or more channels) has not yet been read by any lighting unit. Upon finding such a portion, the lighting unit reads and processes the portion to provide a corresponding light output, and sets the corresponding flag to indicate that the portion has been read. Again, the entire data sequence is transmitted completely from lighting unit to lighting unit, wherein the state of the flags indicate the next portion of the data sequence available for reading and processing.

In one embodiment relating to a serial-based communication protocol, the controller 105 a given lighting unit configured for a serial-based communication protocol may be implemented as an application-specific integrated circuit (ASIC) designed to specifically process a received stream of lighting instructions/data according to the "data stripping/extraction" process or "flag modification" process discussed above. More specifically, in one exemplary embodiment of multiple lighting units coupled together in a series interconnection to form a network, each lighting unit includes an ASIC-implemented controller 105 having the functionality of the processor 102, the memory 114 and communication port(s) 120 shown in FIG. 1 (optional user interface 118 and signal source 124 of course need not be included in some implementations). Such an implementation is discussed in detail in U.S. Pat. No. 6,777,891.

In one embodiment, the lighting unit 100 of FIG. 1 may include and/or be coupled to one or more power sources 108. In various aspects, examples of power source(s) 108 include, but are not limited to, AC power sources, DC power sources, batteries, solar-based power sources, thermoelectric or mechanical-based power sources and the like. Additionally, in one aspect, the power source(s) 108 may include or be associated with one or more power conversion devices or power conversion circuitry (e.g., in some cases internal to the lighting unit 100) that convert power received by an external power source to a form suitable for operation of the various internal circuit components and light sources of the lighting unit 100. In one exemplary implementation discussed in U.S. application Ser. Nos. 11/079,904 and 11/429,715, the controller 105 of the lighting unit 100 may be configured to accept a standard A.C. line voltage from the power source 108 and provide appropriate D.C. operating power for the light sources and other circuitry of the lighting unit based on concepts related to DC-DC conversion, or "switching" power supply concepts. In one aspect of such implementations, the controller 105 may include circuitry to not only accept a standard A. C. line voltage but to ensure that power is drawn from the line voltage with a significantly high power factor.

A given lighting unit also may have any one of a variety of mounting arrangements for the light source(s), enclosure/housing arrangements and shapes to partially or fully enclose the light sources, and/or electrical and mechanical connection configurations. In particular, in some implementations, a lighting unit may be configured as a replacement or "retrofit" to engage electrically and mechanically in a conventional socket or fixture arrangement (e.g., an Edison-type screw socket, a halogen fixture arrangement, a fluorescent fixture arrangement, etc.).

Additionally, one or more optical elements as discussed above may be partially or fully integrated with an enclosure/housing arrangement for the lighting unit. Furthermore, the various components of the lighting unit discussed above (e.g., processor, memory, power, user interface, etc.), as well as other components that may be associated with the lighting unit in different implementations (e.g., sensors/transducers, other components to facilitate communication to and from the unit, etc.) may be packaged in a variety of ways; for example, in one aspect, any subset or all of the various lighting unit components, as well as other components that may be associated with the lighting unit, may be packaged together. In another aspect, packaged subsets of components may be coupled together electrically and/or mechanically in a variety of manners.

Figure 2:
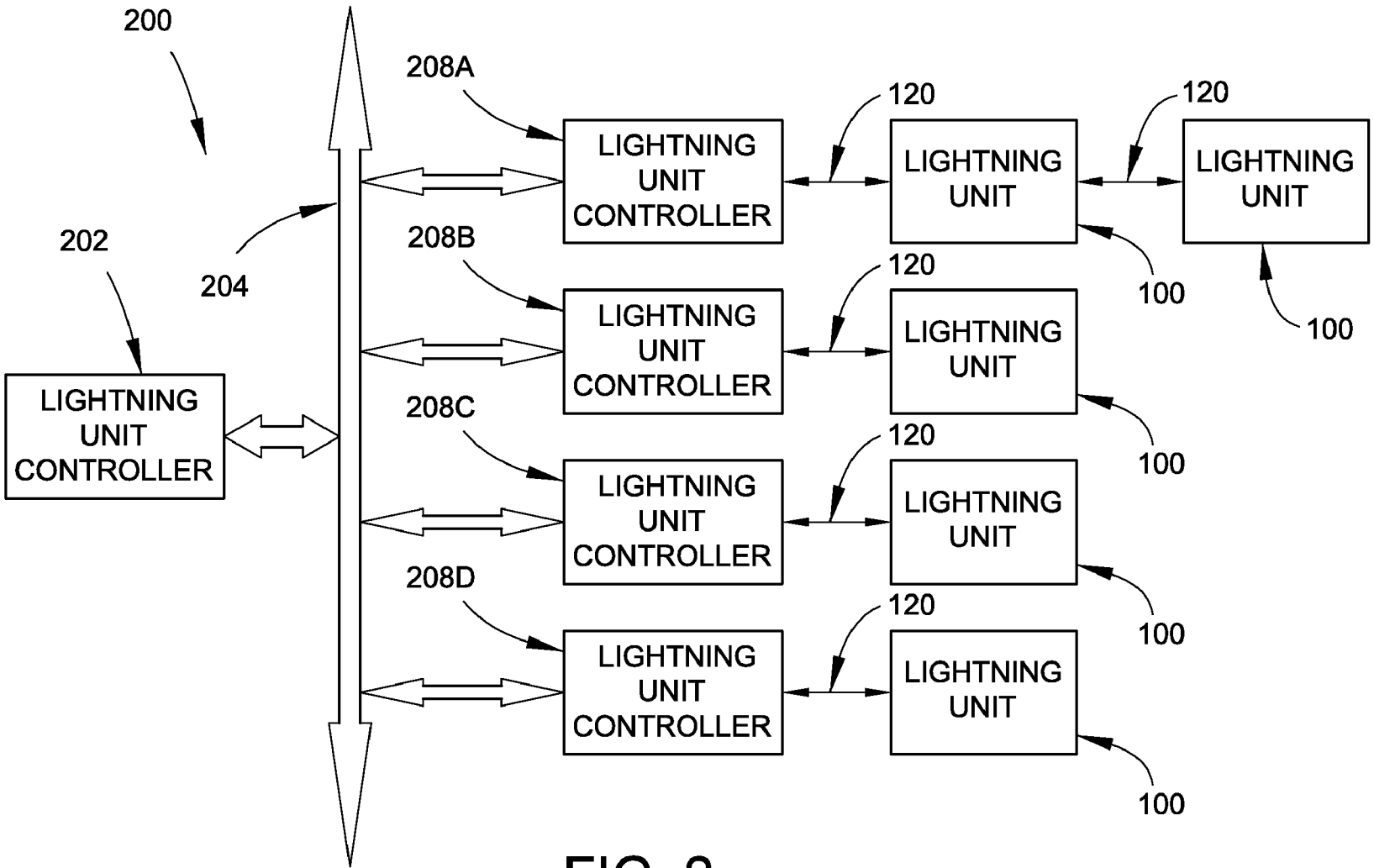
FIG. 2 is a diagram illustrating a networked system of LED-based light sources of FIG. 1.

FIG. 2 illustrates an example of a networked lighting system 200 according to one embodiment of the present disclosure. In the embodiment of FIG. 2, a number of lighting units 100, similar to those discussed above in connection with FIG. 13 are coupled together to form the networked lighting system. It should be appreciated, however, that the particular configuration and arrangement of lighting units shown in FIG. 2 is for purposes of illustration only, and that the disclosure is not limited to the particular system topology shown in FIG. 2.

Additionally, while not shown explicitly in FIG. 2, it should be appreciated that the networked lighting system 200 may be configured flexibly to include one or more user interfaces, as well as one or more signal sources such as sensors/transducers. For example, one or more user interfaces and/or one or more signal sources such as sensors/transducers (as discussed above in connection with FIG. 1) may be associated with any one or more of the lighting units of the networked lighting system 200. Alternatively (or in addition to the foregoing), one or more user interfaces and/or one or more signal sources may be implemented as "stand alone" components in the networked lighting system 200. Whether stand alone components or particularly associated with one or more lighting units 100, these devices may be "shared" by the lighting units of the networked lighting system. Stated differently, one or more user interfaces and/or one or more signal sources such as sensors/transducers may constitute "shared resources" in the networked lighting system that may be used in connection with controlling any one or more of the lighting units of the system.

As shown in the embodiment of FIG. 2, the lighting system 200 may include one or more lighting unit controllers (hereinafter "LUCs") 208A, 208B, 208C, and 208D, wherein each LUC is responsible for communicating with and generally controlling one or more lighting units 100 coupled to it. Although FIG. 2 illustrates two lighting units 100 coupled to the LUC 208A, and one lighting unit 100 coupled to each LUC 208B, 208C and 208D, it should be appreciated that the disclosure is not limited in this respect, as different numbers of lighting units 100 may be coupled to a given LUC in a variety of different configurations (serially connections, parallel connections, combinations of serial and parallel connection, etc.) using a variety of different communication media and protocols.

In the system of FIG. 2, each LUC in turn may be coupled to a central controller 202 that is configured to communicate with one or more LUCs. Although FIG. 2 shows four LUCs coupled to the central controller 202 via a generic connection 204 (which may include any number of a variety of conventional coupling, switching and/or networking devices), it should be appreciated that according to various embodiments, different numbers of LUCs may be coupled to the central controller 202. Additionally, according to various embodiments of the present disclosure, the LUCs and the central controller may be coupled together in a variety of configurations using a variety of different communication media and protocols to form the networked lighting system 200. Moreover, it should be appreciated that the interconnection of LUCs and the central controller, and the interconnection of lighting units to respective LUCs, may be accomplished in different manners (e.g., using different configurations, communication media, and protocols).

For example, according to one embodiment of the present disclosure, the central controller 202 shown in FIG. 2 may by configured to implement Ethernet-based communications with the LUCs, and in turn the LUCs may be configured to implement one of Ethernet-based, DMX-based, or serial-based protocol communications with the lighting units 100 (as discussed above, exemplary serial-based protocols suitable for various network implementation are discussed in detail in U.S. Pat. No. 6,777,891. In particular, in one aspect of this embodiment, each LUC may be configured as an addressable Ethernet-based controller and accordingly may be identifiable to the central controller 202 via a particular unique address (or a unique group of addresses and/or other identifiers) using an Ethernet-based protocol. In this manner, the central controller 202 may be configured to support Ethernet communications throughout the network of coupled LUCs, and each LUC may respond to those communications intended for it. In turn, each LUC may communicate lighting control information to one or more lighting units coupled to it, for example, via an Ethernet, DMX, or serial-based protocol, in response to the Ethernet communications with the central controller 202 (wherein the lighting units are appropriately configured to interpret information received from the LUC in the Ethernet, DMX, or serial-based protocols).

According to one embodiment, the LUCs 208A, 107B, and 108C shown in FIG. 2 may be configured to be "intelligent" in that the central controller 202 may be configured to communicate higher level commands to the LUCs that need to be interpreted by the LUCs before lighting control information can be forwarded to the lighting units 100. For example, a lighting system operator may want to generate a color changing effect that varies colors from lighting unit to lighting unit in such a way as to generate the appearance of a propagating rainbow of colors ("rainbow chase"), given a particular placement of lighting units with respect to one another. In this example, the operator may provide a simple instruction to the central controller 202 to accomplish this, and in turn the central controller may communicate to one or more LUCs using an Ethernet-based protocol high level command to generate a "rainbow chase." The command may contain timing, intensity, hue, saturation or other relevant information, for example. When a given LUC receives such a command, it may then interpret the command and communicate further commands to one or more lighting units using any one of a variety of protocols (e.g., Ethernet, DMX, serial-based), in response to which the respective sources of the lighting units are controlled via any of a variety of signaling techniques (e.g., PWM).

According to another embodiment, one or more LUCs of a lighting network may be coupled to a series connection of multiple lighting units 100 (e.g., see LUC 208A of FIG. 2, which is coupled to two series-connected lighting units 100). In one aspect of such an embodiment, each LUC coupled in this manner is configured to communicate with the multiple lighting units using a serial-based communication protocol, examples of which were discussed above. More specifically, in one exemplary implementation, a given LUC may be configured to communicate with a central controller 202, and/or one or more other LUCs, using an Ethernet-based protocol, and in turn communicate with the multiple lighting units using a serial-based communication protocol. In this manner, a LUC may be viewed in one sense as a protocol converter that receives lighting instructions or data in the Ethernet-based protocol, and passes on the instructions to multiple serially-connected lighting units using the serial-based protocol. Of course, in other network implementations involving DMX-based lighting units arranged in a variety of possible topologies, it should be appreciated that a given LUC similarly may be viewed as a protocol converter that receives lighting instructions or data in the Ethernet protocol, and passes on instructions formatted in a DMX protocol. It should again be appreciated that the foregoing example of using multiple different communication implementations (e.g., Ethernet/(DMX) in a lighting system according to one embodiment of the present disclosure is for purposes of illustration only, and that the disclosure is not limited to this particular example.

From the foregoing, it may be appreciated that one or more lighting units as discussed above are capable of generating highly controllable variable color light over a wide range of colors, as well as variable color temperature white light over a wide range of color temperatures.

Figure 3A:
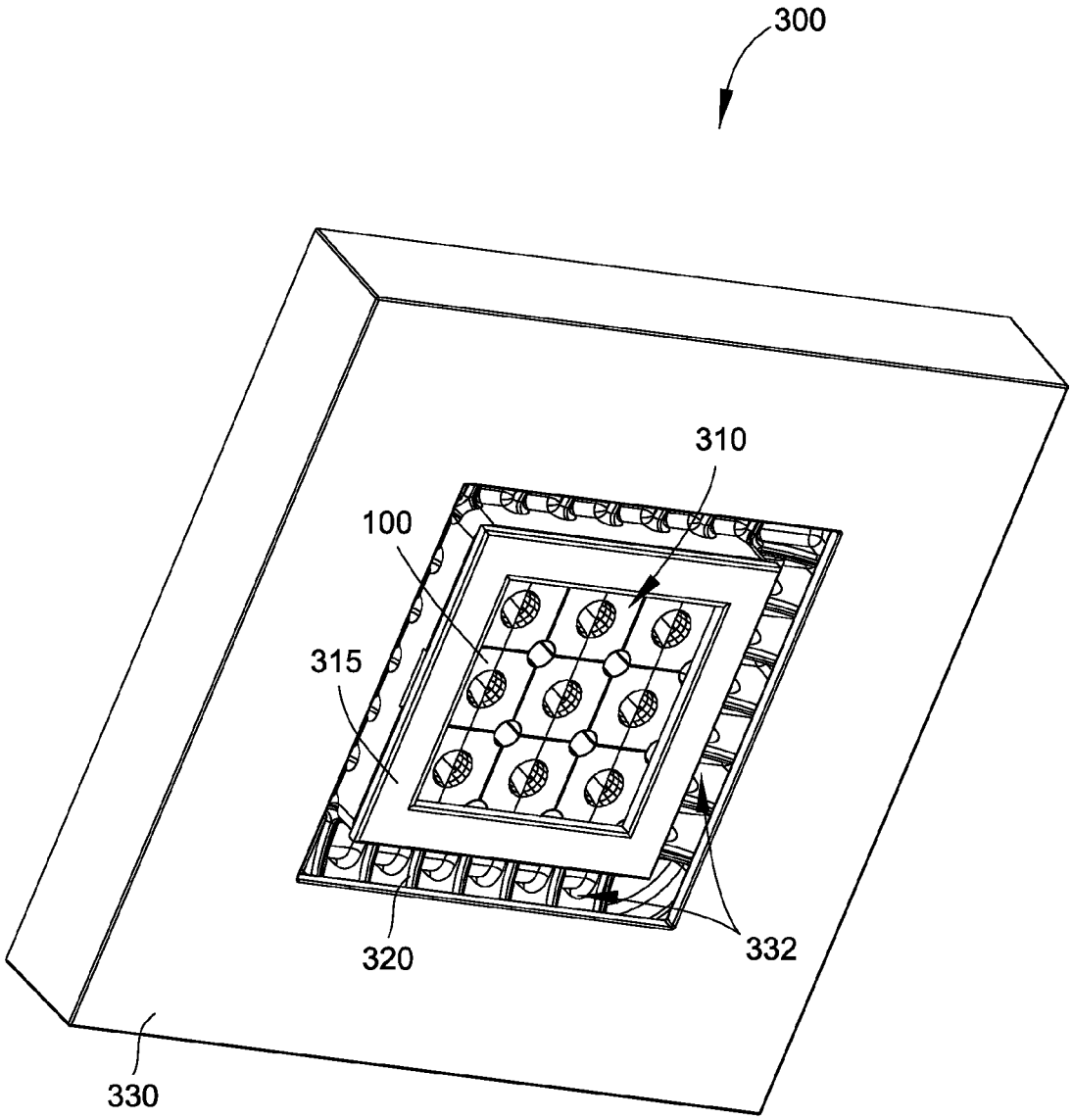
FIG. 3A is a perspective view of a downlight lighting fixture assembly according to one embodiment of the present invention.
Figure 3B:
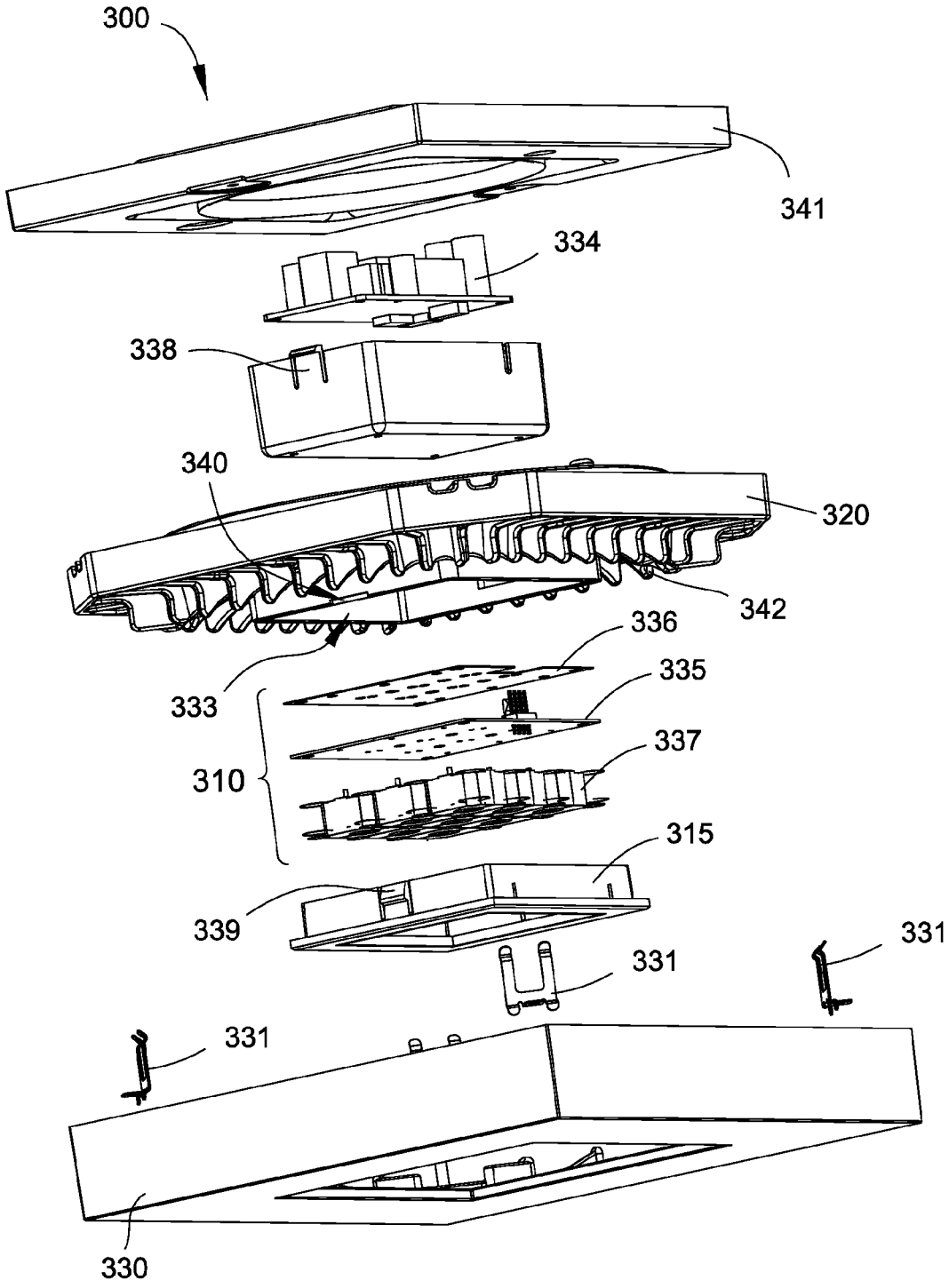
FIG. 3B is an exploded view of the downlight fixture assembly of FIG. 3A.

FIGS. 3A and 3B illustrate an LED-based lighting apparatus 300 according to one embodiment of the present invention. In various aspects, the lighting apparatus 300 includes a variety of features relating to improved heat dissipation, modularity and ease of assembly/disassembly, and a relatively low-profile surface mount form factor. In particular, in one exemplary implementation, the lighting apparatus of FIGS. 3A and 3B is configured as a downlight fixture suitable for general illumination in surface-mount installations, wherein the readily removable components provide a highly modular fixture capable of achieving numerous aesthetic and functional variations.

In various embodiments, the present invention further contemplates creating and maintaining a "chimney effect" within the lighting apparatus and fixtures disclosed herein by providing inlet and outlet air gaps for exhausting heat generated by one or more LED light sources, as well as any power supply/control circuitry included in the lighting apparatus/fixture. In one aspect of facilitating such a chimney effect, one or more heat-dissipating surface areas of the apparatus/fixture is/are configured to be substantially within or along a trajectory of a stream of cooling air flowing through the fixture. In some implementations, extraneous surface area of one or more heat-dissipating elements, not along the trajectory of the cooling air, is omitted, thereby reducing space requirement and, thus, allowing additional functionalities to be added to the fixture. In one embodiment, a majority of a heat-dissipating surface is configured to be along an air flow trajectory (the stream of cooling air) through the fixture. In yet another embodiment, up to 90% or more of the heat-dissipating surface area is configured to be within the air flow trajectory through the fixture. By improving or optimizing the use of space, the present invention contemplates a highly versatile fixture, which, in certain implementations is sleek and modern and, in other implementations, retains conventional dimensions and utilizes the additional space to add improved functionalities over the prior art.

Referring to FIGS. 3A and 3B, in one exemplary embodiment, the lighting apparatus 300 includes an LED module 310, including one or more LEDs 104 or LED-based lighting units 100 as discussed above in connection with FIGS. 1-2, covered by a clear cover lens 315. LED module 310 is disposed in a heat dissipating frame or "heat sink" 320, which is covered by a bezel plate 330. As shown in FIG. 3B, the bezel plate has four stainless steel springs 331 attached to it by screws (not visible in the view of FIG. 3B) and configured to engage respective outside corners of the heat sink so as to mechanically coupled the bezel plate to the heat sink. In various implementations, the heat sink can be made of aluminum or other heat-conducting material by molding, casting, or stamping. The bezel plate and a portion of the heat sink in which the LED module 310 is disposed (covered by the cover lens 315) define an air gap 332 therebetween. As described in greater detail with reference to FIGS. 4A-4B, during the operation of apparatus 300, ambient air is drawn into air gap 332 for cooling the apparatus. Apparatus 300 may be surface mounted to a wall or a ceiling, for example, by attachment to a conventional 4-inch octagon junction box, typically used for pendants or fans.

Referring in particular to FIG. 3B, heat sink 320 has a first recess 333 for receiving LED module 310, which is mounted therein with, for example, screws. In one particular implementation, the LED module 310 includes 9 white LEDs with a color temperature of 2700K, which produce a flux of 300-400 lumens with an efficacy of 30-35 lm/W at 120 VAC input, such as the XR-E 7090 unit available from Cree, Inc. of Durham, N.C. The LED module includes a custom printed circuit board ("PCB") 335, onto which the LED's are soldered, with connectors for ease of replacement. Preferably, a 0.3 mm-thick silicone gap pad 336 is used for thermal connection and electrical isolation between the PCB and the heat sink, at recess 333. The gap pad is made of a heat conductive material, such as graphite. Also, in many implementations, the LED module includes molded polycarbonate reflector optics 337 with a vacuum-metallized reflective coating for collimating the light from the LEDs.

The connection of optics 337 to PCB 335, in accordance with various embodiments of the invention, will now be described. Each collimator optic has two protruding pins that fit into holes located in the PCB to appropriately align each collimator with its corresponding LED light source. When placed within the holes, the pins protrude beyond the back plane of the PCB so that they can be "heat-staked" to the PCB. That is, they are heated so that they soften and deform to a width greater than the hole, thereby securing the collimator to the PCB. The optical components are thus connected in a manner that is easily reworkable, thereby improving production yields, and that provides excellent alignment of the optics to the LED sources. It is also a much faster attachment process than one that uses glue. To maintain excellent heat transfer properties, the heat sink has a number of recesses (not shown) in which the heat-staked pins are disposed, so that the PCB can lay flat on the surface of the heat sink.

Referring to FIG. 3B, the heat sink 320 also has a second recess (not shown) on the side opposite first recess 333, for receiving a power/control module 334 for providing at least operating power to the LED module 310. In one exemplary implementation, the power/control module may be attached via a hook 338 to a latch in a mounting plate 341, which is in turn mounted to a ceiling or wall. The heat sink has captive screws for mounting to the mounting plate and which are held in place during the mounting procedure by spring washers. Clear cover lens 315 has a hook 339 that snaps into a mating portion 340 at the heat sink. In various implementations, the cover lens has an additional snap in the collar portion to add accessories for modifying optical functionality, for example, a hexagonal cell louver, a cross baffle, or a spread lens.

In one embodiment, the heat dissipating frame or heat sink 320 may include a plurality of fins 342 connecting the recess 333 and outer perimeter of the frame 320, as shown in FIG. 3B. In one aspect of this embodiment, the heat-dissipating frame may be configured such that most of its surface area is disposed along the trajectory of the cooling ambient air flow. By minimizing the volume of the heat sink outside of the trajectory of the cooling ambient air flow, the use of space within the apparatus 300 is optimized, thereby reducing materials requirements and weight, as well as providing greater versatility with the design of other components, such as bezel plate 330. For examples, crisp, square edges can be employed for a minimalist, contemporary look, or curves can be achieved for a softer look. In one particular implementation, the heat-dissipating fins have a curved, recessed configuration, tracking the trajectory of the cooling air, as is described in greater detail with reference to FIGS. 4A-4B.

Thus, certain embodiments of the present invention produce a compact lighting apparatus in the form of a downlight fixture of sleek, modern design adaptable to many spatial configurations, installations, and applications. For example, the fixture may have an overall depth from the mounting surface of about 2 inches, as well as an eight-inch side (square) or diameter. In alternative implementations, the overall form factor is similar to that of conventional fixtures, and the additional space is employed to house additional components not found in conventional fixtures. For example, a back-up battery can be housed within the fixture, for example, proximate to the control/power management module. In this manner, emergency lighting is realized without consuming space beyond that required by the general illumination system, and/or without requiring an emergency lighting system that is separate from the general illumination system of an illuminated space. For implementations having emergency back-up functionality, power/control module 334 may include conventional circuitry for triggering battery usage upon the loss of power.

Also, as mentioned above, the lighting apparatus 300 may have a modular configuration in which components can be selectively replaced. Because of the minimal use of adhesives, components can be detached by removing screws or unsnapping snaps or disengaging springs. Thus, bezel plate 330 can be replaced with another bezel of a different color or design; cover lens 315 can be unsnapped from heat sink 320 and replaced with another lens having different optical properties, that alter the beam angle or diffusion of the light; LED module 310 or a component thereof, such as the collimators, can be removed from the heat sink structure to be replaced with another module/component that provides different LED-derived light properties (e.g., white or color light, or a different light temperature); power/control module 334 can be disengaged from mounting plate 341, to provide another module that is, for example, useful at a different voltage. Such modularity also significantly reduces waste associated with the disposal of malfunctioning fixtures, as occurs with conventional fixtures. In particular, individual components of downlight 300 can be accessed and repaired or selectively replaced with functioning components, thereby obviating the need to dispose of the entire fixture when only one subcomponent is malfunctioning.

Figure 4A:
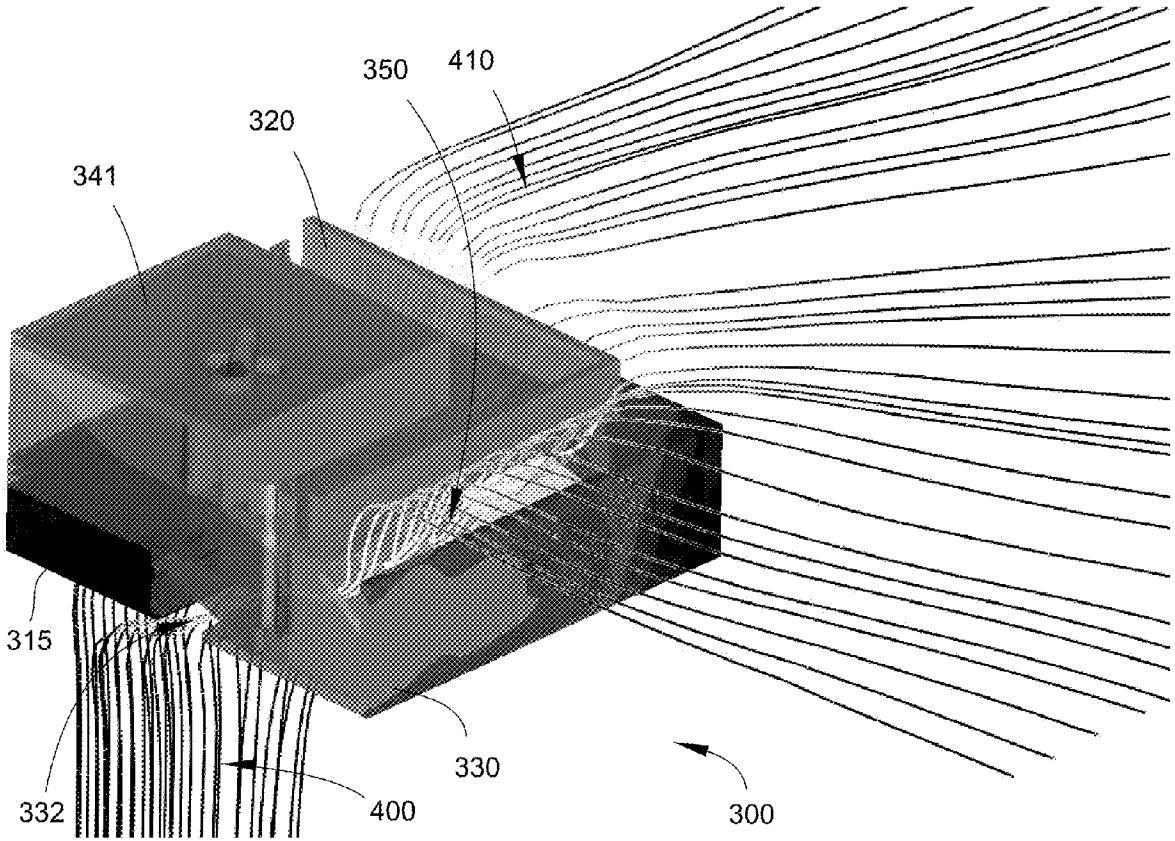
FIGS. 4A and 4B illustrate computational fluid dynamics ("CFD") computer simulations of air flow distribution in a downlight fixture assembly, according to one embodiment of the present invention.
Figure 4B:
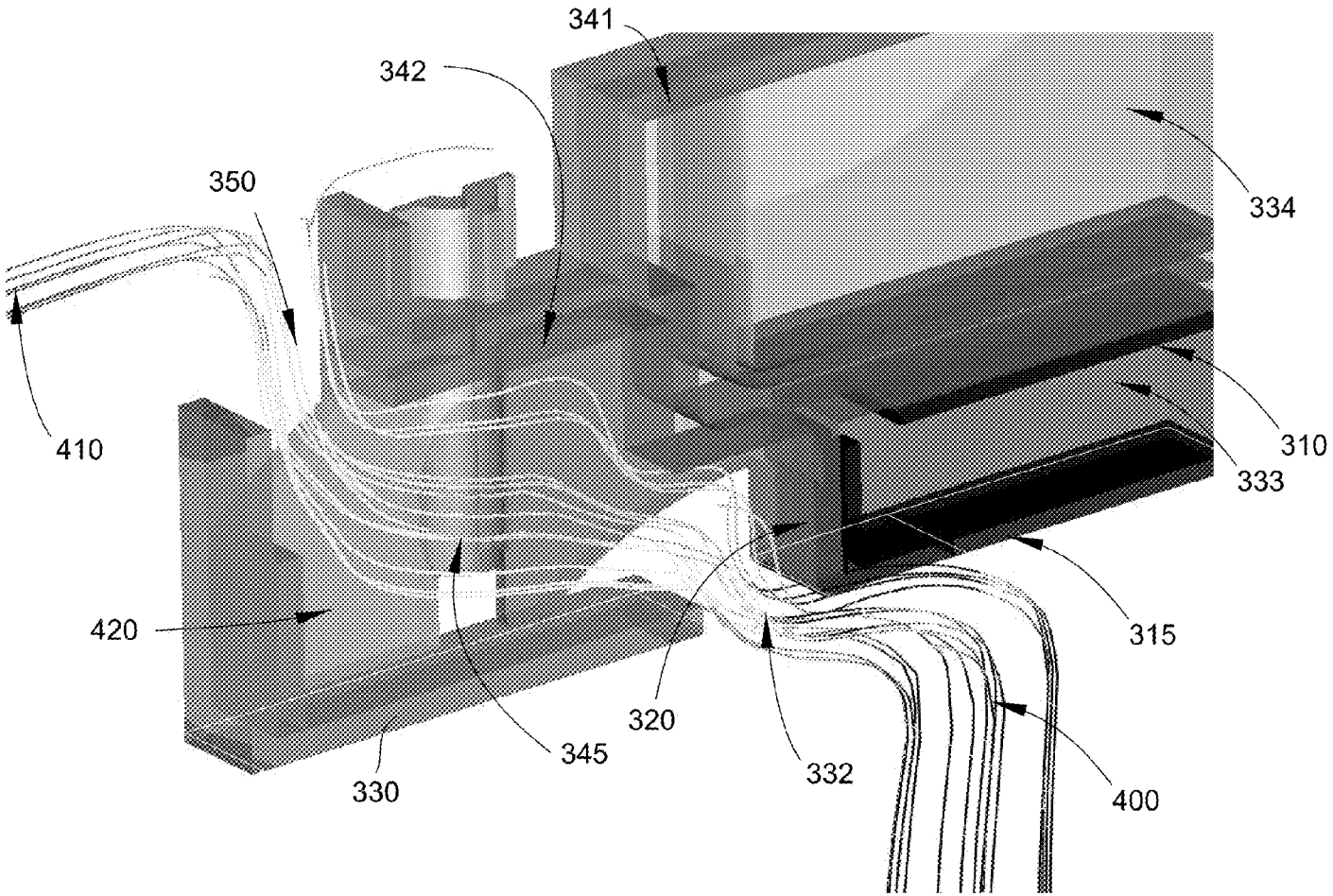

Referring to FIGS. 4A-4B, a method for cooling a fixture in accordance with the present invention will now be described, thereby realizing efficient operation, significantly improved performance, and long operating life of the device. As skilled artisans will readily recognize, a "chimney effect" (also known as a "stack effect") is a movement of air into and out of structures, e.g. buildings or containers, driven by buoyancy, occurring due to a difference between interior and exterior air density resulting from temperature and moisture differences. Various embodiments of the present invention employ this effect to facilitate heat dissipation when the lighting apparatus 300 is in operation (i.e., drawing power and generating light). In particular, the apparatus has an inlet air gap 332 through which air is drawn into the fixture without the use of a fan, and an air channel connecting the inlet air gap to an outlet air gap or region through which air flowing through the apparatus is exhausted after it has made contact with the heat sink. In various implementations, the surface area of the heat sink structure is configured to generally track the trajectory of the cooling ambient air flow through the air channel within the apparatus.

Referring particularly to FIG. 4A, ambient air 400 enters the lighting apparatus 300 via inlet air gap 332, which is disposed between the bezel plate 330 and the recess 333 of the heat sink 320 in which the LED module 310 and cover lens 315 are situated. As shown in FIG. 4B, the cooling ambient air 400 flows through an air channel 345 in the apparatus 300, between an interior portion of the bezel plate 330 and the heat sink 320, such that the flow of cooling ambient air 400 makes contact with heat sink 320 at fins 342, drawing heat from the fins. The heat is removed in effluent air 410, which flows out of the apparatus at outlet air gaps/regions 350, located between the heat sink and the bezel plate 330 closer to a surface to which the mounting plate 341 is attached.

As also shown in FIG. 4B, a region 420 is identified that is proximate to the air channel 345 but not disposed immediately along the trajectory of significant air flow. In one aspect, the region 420 may be characterized by stagnant, recirculating and/or insignificant air flow. Identifying such regions in designing various implementations of the apparatus 300 facilitates a recessed, more compact configuration of the heat sink, for example, as shown in FIG. 3B. In particular, in some embodiments, insignificant air flow regions such as the region 420 are identified (e.g., using commercially available computational fluid dynamics or "CFD" flow modeling software). Based on such an analysis, the heat sink 320 may be particularly designed and configured such that the location of heat sink surfaces in any such insignificant air flow regions is significantly reduced or minimized.

More specifically, in some embodiments, the placement of heat sink surfaces within the apparatus 300 may be optimized so that these surfaces are located primarily or solely in regions of sufficient or significantly high air flow velocities. In one aspect, a region of significant air flow velocity constitutes a region in which the air flow velocity is at least approximately 5% of the maximum air flow velocity in the air channel. In another aspect, a region of significant air flow velocity may constitute a region in which the air flow velocity is at least approximately 10% (or higher) of the maximum air flow velocity in the air channel. By reducing the volume of the heat sink disposed proximate to regions similar to the region 420, the overall weight and profile of the fixture may be reduced or minimized while achieving desired or optimal levels of heat dissipation and improving design flexibility. Thus, as shown in FIGS. 4A and 4B, a lighting fixture in accordance with the present invention provides efficient heat removal from the LED module and control/power management module.

Figure 5A:
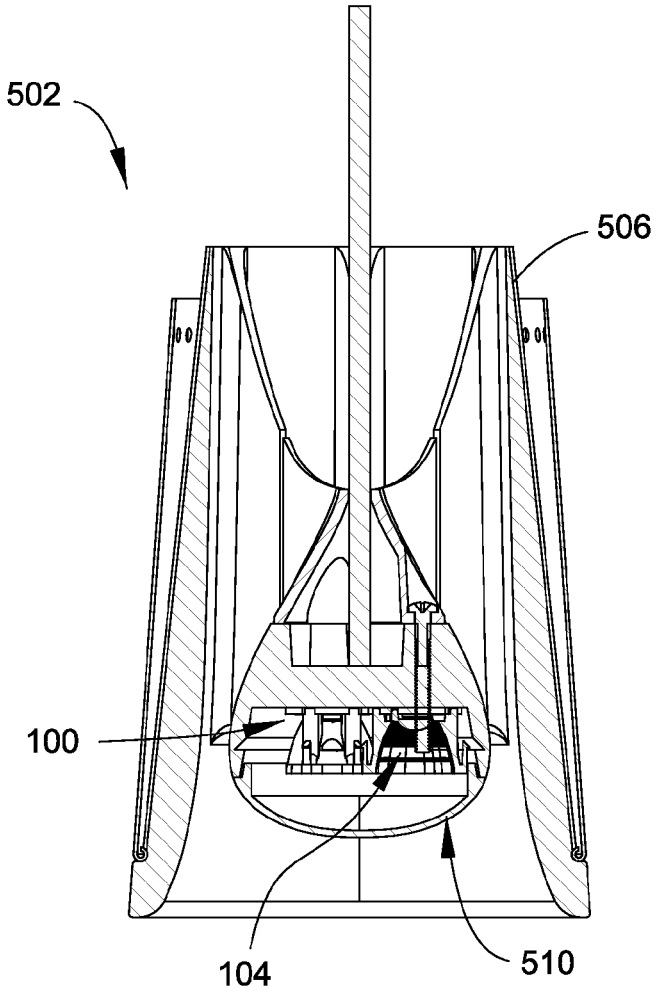
FIG. 5A is a cross-sectional side view of a hanging spot pendant fixture according to one embodiment of the present invention.
Figure 5B:
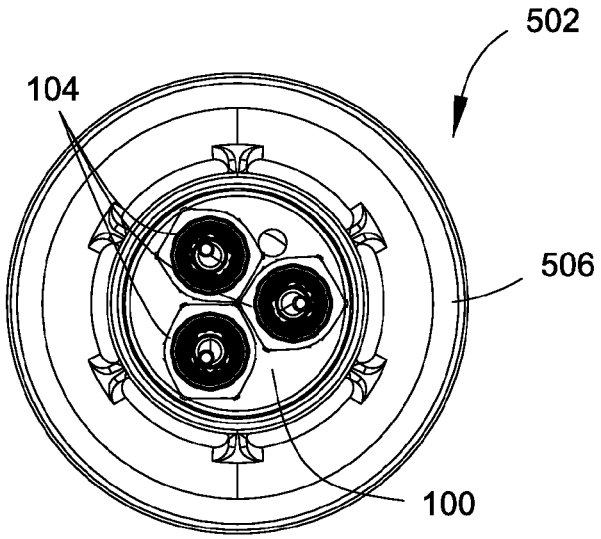
FIG. 5B is a bottom view of the pendant fixture of FIG. 5A.

Another embodiment of the invention is directed to a hanging spot pendant fixture, as shown in FIGS. 5A and 5B, particularly suitable for the general ambient illumination of a small, intimate environment. In some versions, this fixture is configured to emit about 300 lumens while consuming approximately 10 watts of energy and has a height of about 6" and an outside diameter of the downward end of about 4". As in the embodiments discussed above, the spot pendant fixture includes various features for improving heat dissipation properties by increasing a surface area and decreasing thermal resistance between an LED junction and the ambient air. Referring to FIG. 5A, a lighting fixture 502 includes one or more LEDs 104 and associated power/control circuitry (e.g., an LED-based lighting unit 100) centrally disposed in a hollow housing 506 formed from a heat-conducting material (e.g. die-cast aluminum) and secured within a bore of the housing 506 by a plurality of support members that forming an air gap between the housing and the LEDs/LED-based lighting unit, as shown in FIG. 5B. In some implementations, an air gap may be formed between housing 506 and a lens cover 510. In particular implementations, the fixture 502 is configured such that the width of the gap decreases in an upward direction, i.e. towards the mounting end of the fixture. Thus, similar to the surface-mount downlight fixture discussed above, pendant fixture 502 is configured to employ a "chimney effect" to facilitate heat dissipation. As mentioned above, this buoyancy effect is based on the principle that hotter air is less dense than cool air. When less dense, hot air is disposed over a cooler, denser inlet of ambient air, the cool air rushes upwards in an attempt to equalize pressure. Combined with the dynamic physics of a fluid medium (e.g. jet stream) moving through a pipe and the fact that velocity of the flow increases as the pipe diameter decreases, the heat generated by the LEDs is efficiently dissipated at an accelerated convection flow rate.

Figure 6A:
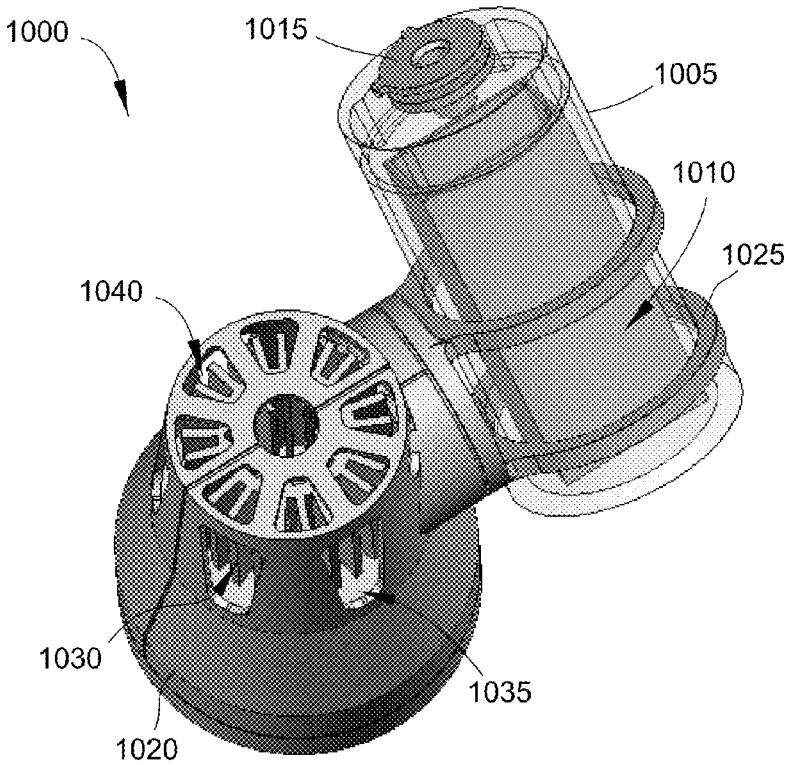
FIGS. 6A and 6B are perspective views of a track head fixture according to one embodiment of the present invention.
Figure 6B:
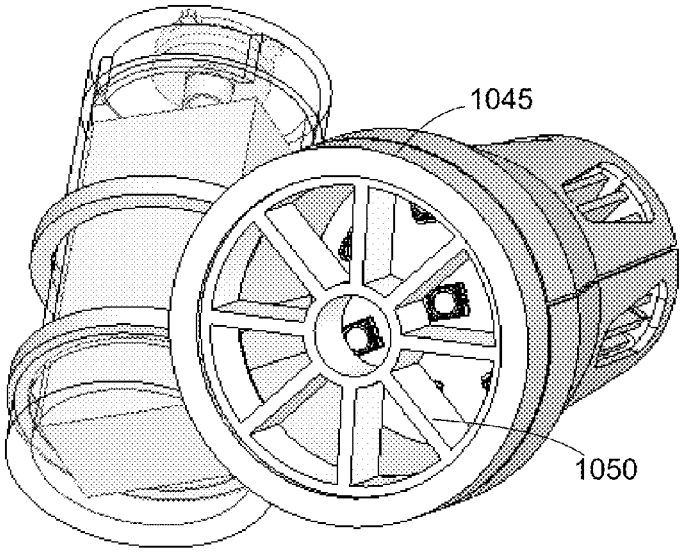

In still another embodiment, the heat dissipation approach described above can also be employed for a track head fixture 1000, shown in FIGS. 6A and 6B. This fixture can be configured for installation with a conventional open architecture track. Referring again to FIGS. 6A and 6B, in one implementation the fixture includes a hollow cylinder 1005 (shown as transparent in FIGS. 6A and 6B for illustration purposes) that houses a power/control module 1010 and includes an end cap 1015 having a female connector 1018 for attaching the cylinder to the track adaptor 1110. A set of bundled wires runs auxiliary from the side of the cylinder to the fixture head. A lighting module including one or more LEDs 104 (e.g. LED PCB) and optionally other components of an LED-based lighting apparatus 100 (e.g., including an optical facility) is disposed in the fixture head mounted over a web structure (not shown). An extruded heat sink 1030 is mounted inside the fixture housing to the back surface of the web structure. The heat sink is partially exposed to the ambient air through a plurality of vents 1035, 1040, as shown in FIGS. 6A and 6B, such that the ambient air may penetrate the housing directly to a base portion of the heat sink structure. An accessory ring 1045 may hold various combinations of louvers and lenses. This ring may be used to protect optics and create customized looks as well as increase or decrease desired light levels/cut-off angles/beam profiles. One louver style 1050 is shown in FIG. 6B.

Similar to the surface-mount downlight and pendant fixtures discussed above, the fixture head of this embodiment is configured to employ a "chimney effect" to facilitate heat dissipation. As shown in FIG. 6A, side air vents 1035 disposed on the side of the fixture head housing cylinder draw cool ambient air to the bottom portion of the heat sink 1020. With the heat generated by the lighting module rising through fins of the heat sink structure, the air is then exhausted through rear vents 1040 out the fixture.

With respect to the power supply/control circuitry for the lighting apparatus and fixtures described herein, in various embodiments power may be supplied to a light generating load (e.g., one or more LEDs 104 or one or more LED-based lighting units 100) included in any given apparatus or fixture without requiring any feedback information associated with the load. For purposes of the present disclosure, the phrase "feedback information associated with a load" refers to information relating to the load (e.g., a load voltage and/or load current of the LED light sources) obtained during normal operation of the load (i.e., while the load performs its intended functionality), which information is fed back to the power supply providing power to the load so as to facilitate stable operation of the power supply (e.g., the provision of a regulated output voltage). Thus, the phrase "without requiring any feedback information associated with the load" refers to implementations in which the power supply providing power to the load does not require any feedback information to maintain normal operation of itself and the load (i.e., when the load is performing its intended functionality).

Figure 7:
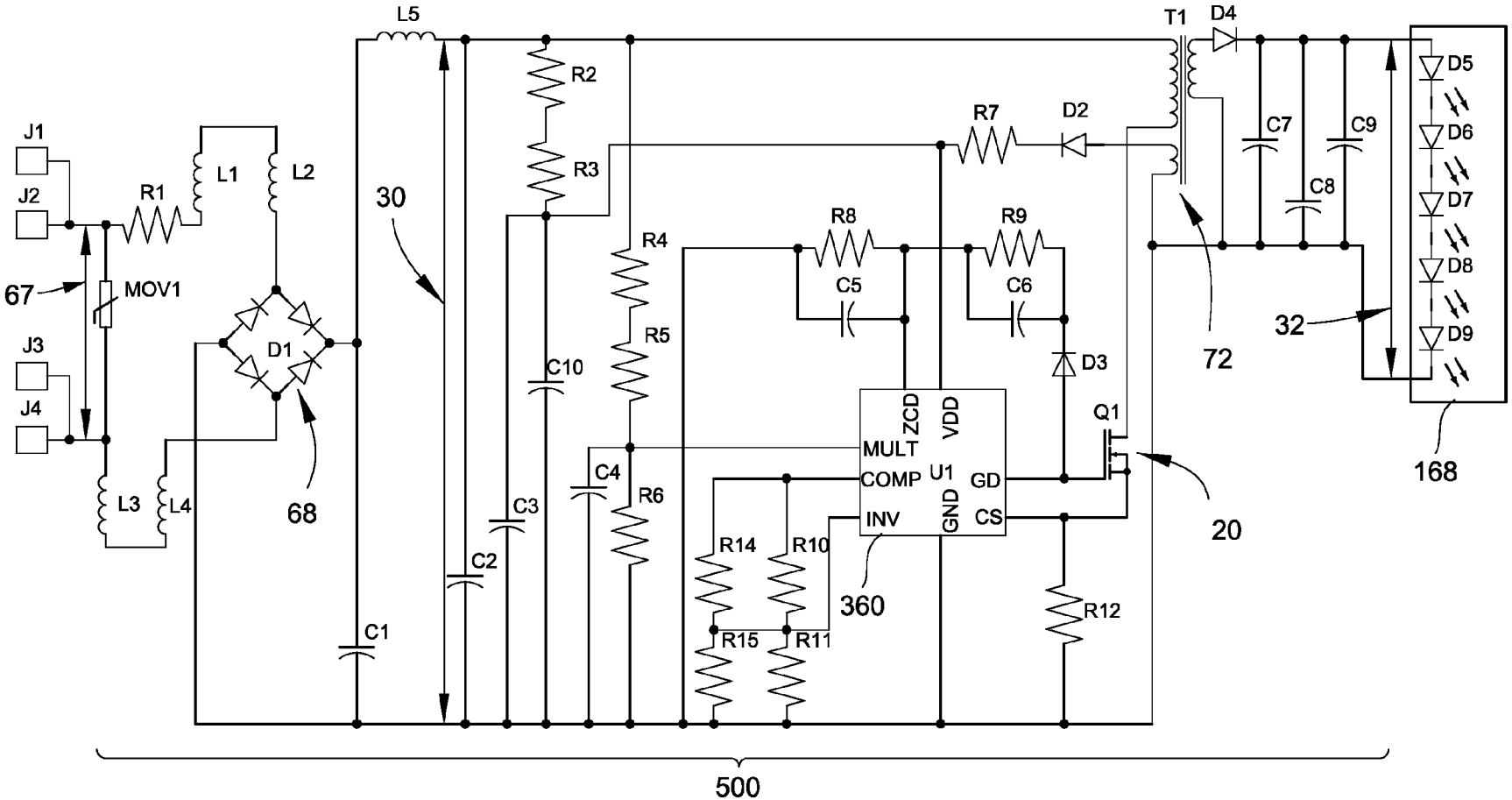
FIG. 7 is a schematic circuit diagram of a power supply for providing power to lighting apparatus and fixtures according to one embodiment of the present invention.

FIG. 7 is a schematic circuit diagram illustrating an example of a high power factor, single switching stage, power supply 500 according to one embodiment of the present invention to provide power to a light generating load 168, which again in various embodiments of lighting fixtures disclosed herein may include one or more LEDs 104 or one or more LED-based lighting units 100. In one exemplary implementation, with reference again for the moment to FIG. 3B, the power supply 500 (or any one of alternative power supplies described below) may be disposed within the power/control module 334 of the lighting apparatus 300. Similarly, in connection with the embodiment illustrated in FIGS. 6A and 6B, the power supply 500 or any one of alternative power supplies described below may be disposed within the power/control module 1010.

In one aspect, the power supply 500 shown in FIG. 7 is based on a flyback converter arrangement employing a switch controller 360 implemented by an ST6561 or ST6562 switch controller available from ST Microelectronics. An A.C. input voltage 67 is applied to the power supply 500 at the terminals J1 and J2 (or J3 and J4) shown on the far left of the schematic, and a D.C. output voltage 32 (or supply voltage) is applied across a light generating load 168 which includes five LEDs. In one aspect, the output voltage 32 is not variable independently of the A.C. input voltage 67 applied to the power supply 500; stated differently, for a given A.C. input voltage 67, the output voltage 32 applied across the load 168 remains essentially substantially stable and fixed. It should be appreciated that the particular load is provided primarily for purposes of illustration, and that the present disclosure is not limited in this respect; for example, in other embodiments of the invention, the load may include a same or different number of LEDs interconnected in any of a variety of series, parallel, or series/parallel arrangements. Also, as indicated in Table 1 below, the power supply 500 may be configured for a variety of different input voltages, based on an appropriate selection of various circuit components (resistor values in Ohms).

TABLE 1

| A.C. Input Voltage | R2 | R3 | R4 | R5 | R6 | R8 | R10 | R11 | Q1 |
|---|---|---|---|---|---|---|---|---|---|
| 120 V | 150K | 150K | 750K | 750K | 10.0K 1% | 7.5K | 3.90K 1% | 20.0K 1% | 2SK3050 |
| 230 V | 300K | 300K | 1.5 M | 1.5 M | 4.99K 1% | 11K | 4.30K 1% | 20.0K 1% | STD1NK80Z |
| 100 V | 150K | 150K | 750K | 750K | 10.0K 1% | 7.5K | 2.49K 1% | 10.0K 1% | 2SK3050 |
| 120 V | 150K | 150K | 750K | 750K | 10.0K 1% | 7.5K | 3.90K 1% | 20.0K 1% | 2SK3050 |
| 230 V | 300K | 300K | 1.5 M | 1.5 M | 4.99K 1% | 11K | 4.30K 1% | 20.0K 1% | STD1NK80Z |
| 100 V | 150K | 150K | 750K | 750K | 10.0K 1% | 7.5K | 2.49K 1% | 10.0K 1% | 2SK3050 |

In one aspect of the embodiment shown in FIG. 7, the controller 360 is configured to employ a fixed-off time (FOT) control technique to control a switch 20 (Q1). The FOT control technique allows the use of a relatively smaller transformer 72 for the flyback configuration. This allows the transformer to be operated at a more constant frequency, which in turn delivers higher power to the load for a given core size.

In another aspect, unlike conventional switching power supply configurations employing either the L6561 or L6562 switch controllers, the switching power supply 500 of FIG. 7 does not require any feedback information associated with the load to facilitate control of the switch 20 (Q1). In conventional implementations involving the STL6561 or STL6562 switch controllers, the IV input (pin 1) of these controllers (the inverting input of the controller's internal error amplifier) typically is coupled to a signal representing the positive potential of the output voltage (e.g., via an external resistor divider network and/or an optoisolator circuit), so as to provide feedback associated with the load to the switch controller. The controller's internal error amplifier compares a portion of the fed back output voltage with an internal reference so as to maintain an essentially constant (i.e., regulated) output voltage.

In contrast to these conventional arrangements, in the circuit of FIG. 7, the INV input of the switch controller 360 is coupled to ground potential via the resistor R11, and is not in any way deriving feedback from the load (e.g., there is no electrical connection between the controller 360 and the positive potential of the output voltage 32 when it is applied to the light generating load 168). More generally, in various inventive embodiments disclosed herein, the switch 20 (Q1) may be controlled without monitoring either the output voltage 32 across the load or a current drawn by the load when the load is electrically connected to the output voltage 32. Similarly, the switch Q1 may be controlled without regulating either the output voltage 32 across the load or a current drawn by the load. Again, this can be readily observed in the schematic of FIG. 11, in that the positive potential of the output voltage 32 (applied to the anode of LED D5 of the load 100) is not electrically connected or "fed back" to any component on the primary side of transformer 72.

By eliminating the requirement for feedback, various lighting fixtures according to the present invention employing a switching power supply may be implemented with fewer components at a reduced size/cost. Also, due to the high power factor correction provided by the circuit arrangement shown in FIG. 7, the lighting fixture appears as an essentially resistive element to the applied input voltage 67.

Figure 7A:
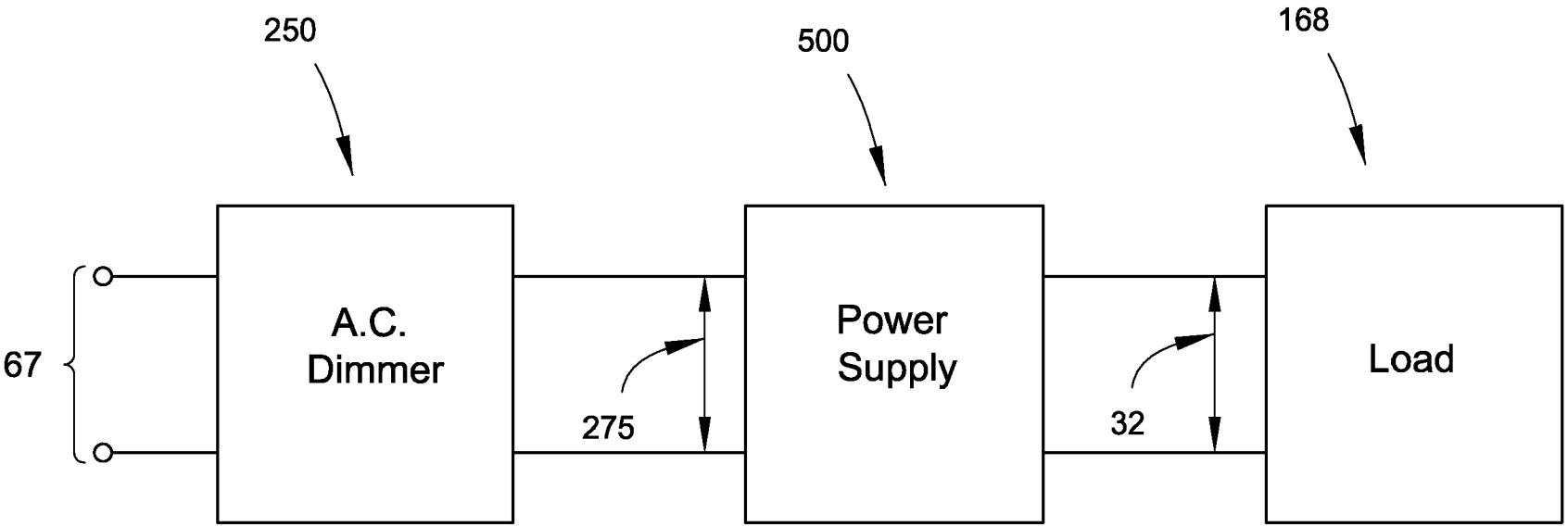
FIG. 7A is a block diagram showing a lighting system including an A.C. dimmer coupled to the power supply of FIG. 7, according to one embodiment of the present invention.

In some exemplary implementations, as shown in FIG. 7A, a lighting fixture including the power supply 500 may be coupled to an A.C. dimmer 250, wherein an A.C. voltage 275 applied to the power supply is derived from the output of the A.C. dimmer (which in turn receives as an input the A.C. line voltage 67). In various aspects, the voltage 275 provided by the A.C. dimmer 250 may be a voltage amplitude controlled or duty-cycle (phase) controlled A.C. voltage, for example. In one exemplary implementation, by varying an RMS value of the A.C. voltage 275 applied to the power supply 500 via the A.C. dimmer, the output voltage 32 to the load 168 may be similarly varied. In this manner, the A.C. dimmer may thusly be employed to vary a brightness of light generated by the load 168. It should be appreciated that the A.C. dimmer 250 similarly may be employed with power supplies according to other embodiments, as discussed below in connection with FIGS. 8-11.

Figure 8:
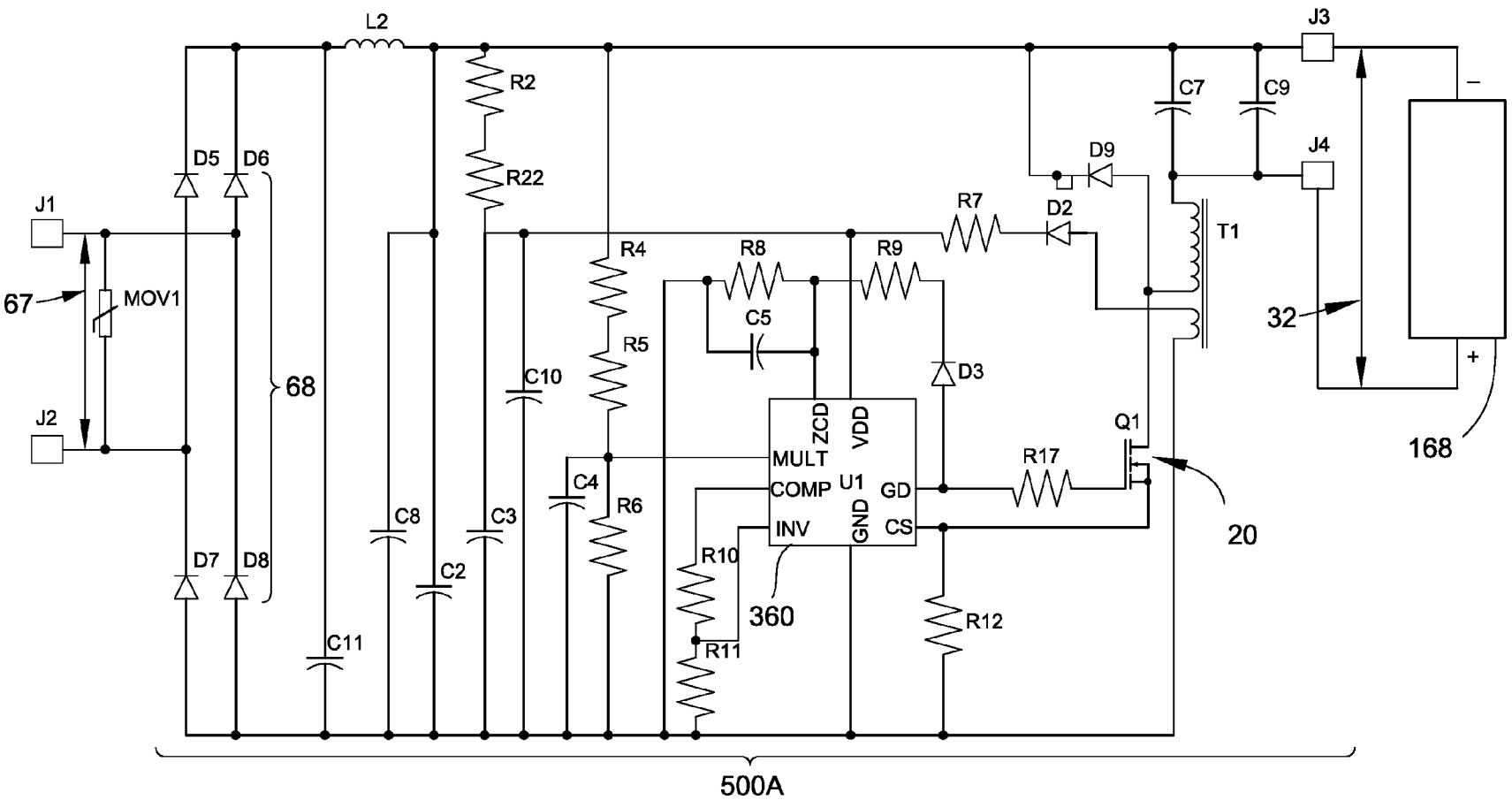
FIGS. 8-11 are schematic circuit diagrams of power supplies for providing power to lighting apparatus and fixtures according to other embodiments of the present invention.

FIG. 8 is a schematic circuit diagram illustrating an example of a high power factor single switching stage power supply 500A. The power supply 500A is similar in several respects to that shown in FIG. 7; however, rather than employing a transformer in a flyback converter configuration, the power supply of FIG. 8 employs a buck converter topology. This allows a significant reduction in losses when the power supply is configured such that the output voltage is a fraction of the input voltage. The circuit of FIG. 8, like the flyback design employed in FIG. 7, achieves a high power factor. In one exemplary implementation, the power supply 500A is configured to accept an input voltage 67 of 120 VAC and provide an output voltage 32 in the range of approximately 30 to 70 VDC. This range of output voltages mitigates against increasing losses at lower output voltages (resulting in lower efficiency), as well as line current distortion (measured as increases in harmonics or decreases in power factor) at higher output voltages.

The circuit of FIG. 8 utilizes the same design principles which result in the apparatus exhibiting a fairly constant input resistance as the input voltage 67 is varied. The condition of constant input resistance may be compromised, however, if either 1) the AC input voltage is less than the output voltage, or 2) the buck converter is not operated in the continuous mode of operation. Harmonic distortion is caused by 1) and is unavoidable. Its effects can only be reduced by changing the output voltage allowed by the load. This sets a practical upper bound on the output voltage. Depending on the maximum allowed harmonic content, this voltage seems to allow about 40% of the expected peak input voltage. Harmonic distortion is also caused by 2), but its effect is less important because the inductor (in transformer T1) can be sized to put the transition between continuous/discontinuous mode close to the voltage imposed by 1). In another aspect, the circuit of FIG. 8 uses a high speed Silicon Carbide Schottky diode (diode D9) in the buck converter configuration. The diode D9 allows the fixed-off time control method to be used with the buck converter configuration. This feature also limits the lower voltage performance of the power supply. As output voltage is reduced, a larger efficiency loss is imposed by the diode D9. For appreciably lower output voltages, the flyback topology used in FIG. 7 may be preferable in some instances, as the flyback topology allows more time and a lower reverse voltage at the output diode to achieve reverse recovery, and allows the use of higher speed, but lower voltage diodes, as well as silicon Schottky diodes as the voltages are reduced. Nonetheless, the use of a high speed Silicon Carbide Schottky diode in the circuit of FIG. 8 allows FOT control while maintaining a sufficiently high efficiency at relatively low output power levels.

Figure 9:
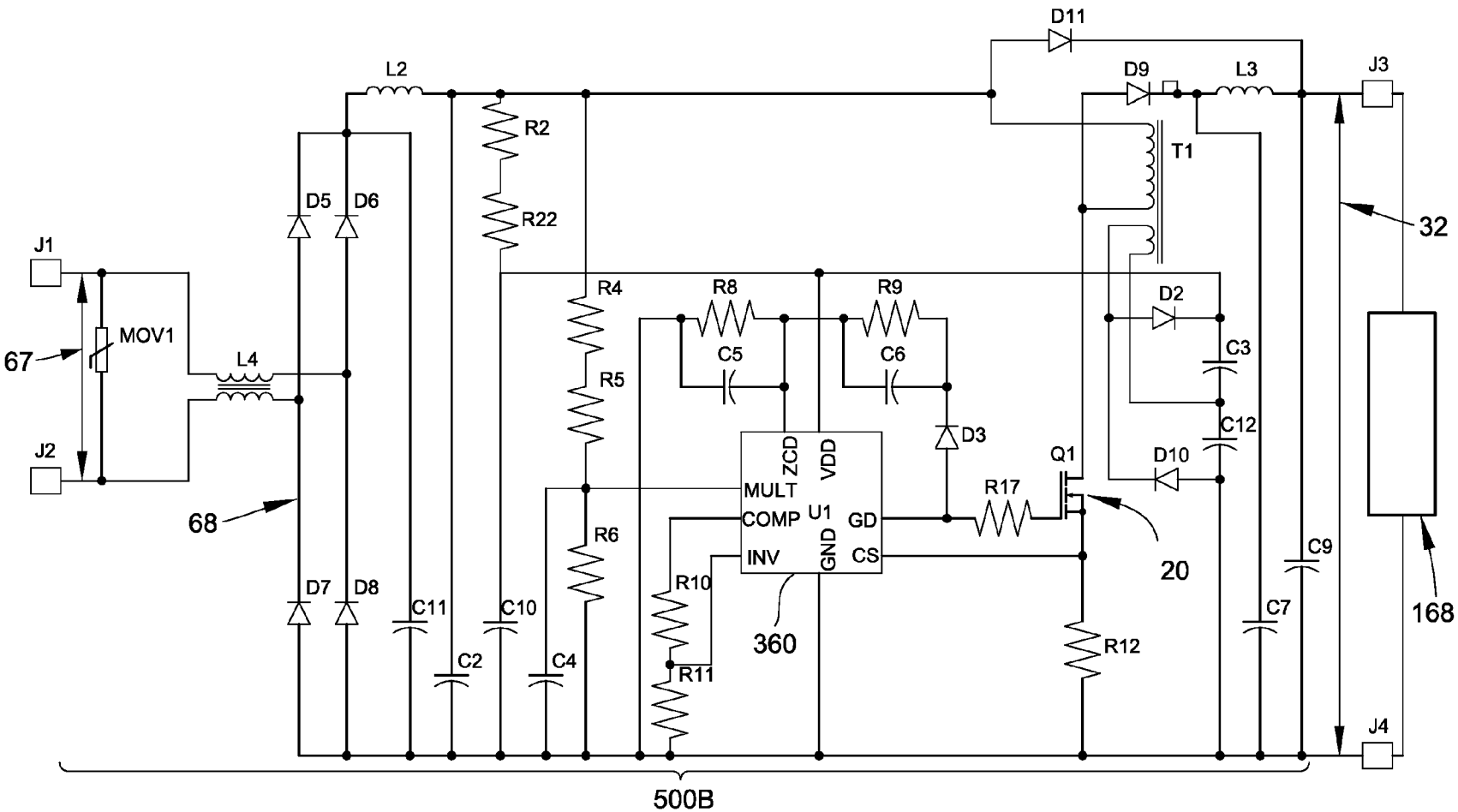

FIG. 9 is a schematic circuit diagram illustrating an example of a high power factor single switching stage power supply 500B according to another embodiment. In the circuit of FIG. 9, a boost converter topology is employed for the power supply 500B. This design also utilizes the fixed off time (FOT) control method, and employs a Silicon Carbide Schottky diode to achieve a sufficiently high efficiency. The range for the output voltage 32 is from slightly above the expected peak of the A.C. input voltage, to approximately three times this voltage. The particular circuit component values illustrated in FIG. 9 provide an output voltage 32 on the order of approximately 300 VDC. In some implementations of the power supply 500B, the power supply is configured such that the output voltage is nominally between 1.4 and 2 times the peak A.C. input voltage. The lower limit (1.4×) is primarily an issue of reliability; since it is worthwhile to avoid input voltage transient protection circuitry due to its cost, a fair amount of voltage margin may be preferred before current is forced to flow through the load. At the higher end (2×), it may be preferable in some instances to limit the maximum output voltage, since both switching and conduction losses increase as the square of the output voltage. Thus, higher efficiency can be obtained if this output voltage is chosen at some modest level above the input voltage.

Figure 10:
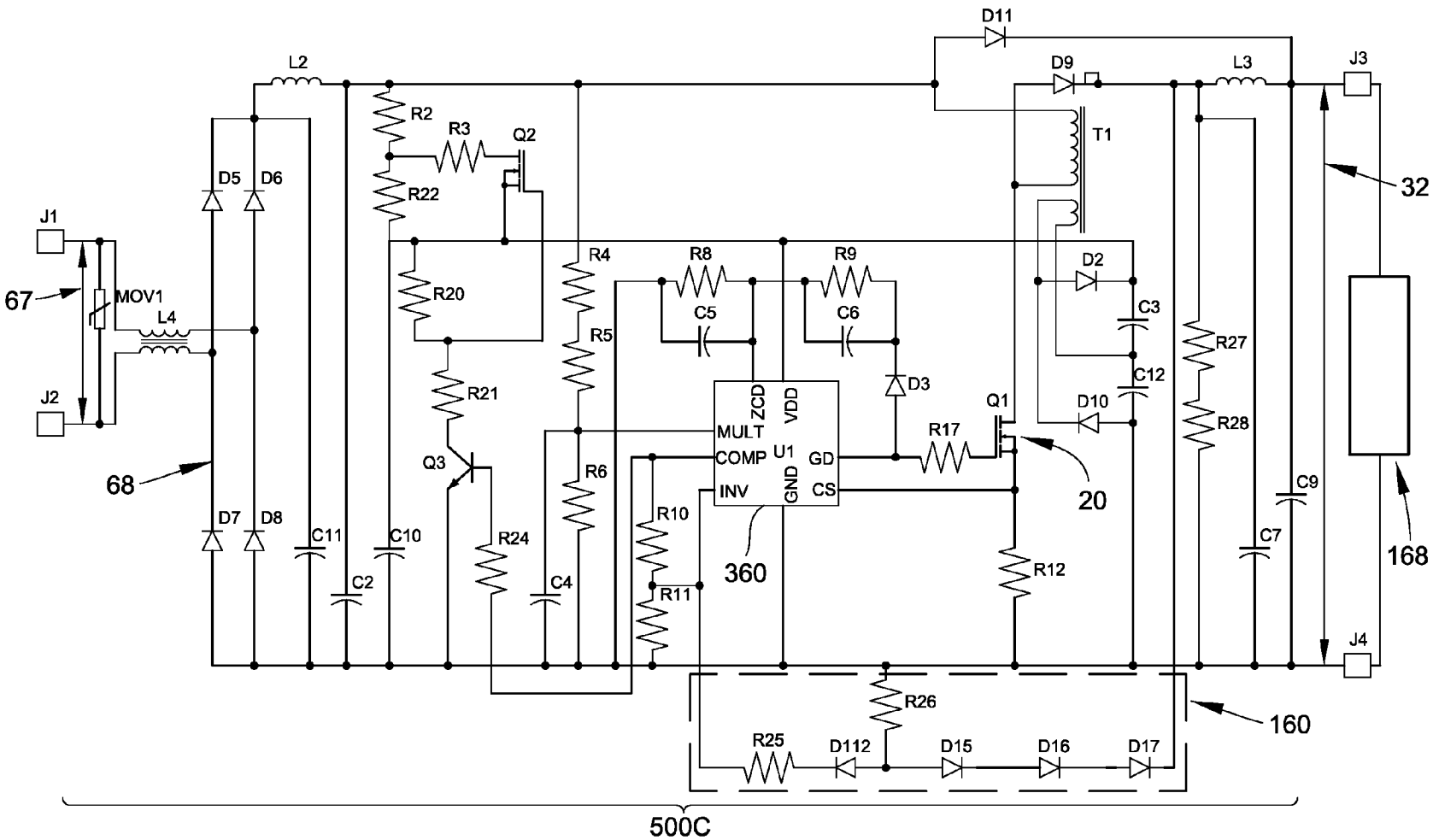

FIG. 10 is a schematic diagram of a power supply 500C according to another embodiment, based on the boost converter topology discussed above in connection with FIG. 9. Because of the potentially high output voltages provided by the boost converter topology, in the embodiment of FIG. 10, an over-voltage protection circuit 160 is employed to ensure that the power supply 500C ceases operation if the output voltage 32 exceeds a predetermined value. In one exemplary implementation, the over-voltage protection circuit includes three series-connected zener diodes D15, D16 and D17 that conduct current if the output voltage 32 exceeds approximately 350 Volts.

More generally, the over-voltage protection circuit 160 is configured to operate only in situations in which the load ceases conducting current from the power supply 500C, i.e., if the load is not connected or malfunctions and ceases normal operation. The over-voltage protection circuit 160 is ultimately coupled to the NV input of the controller 360 so as to shut down operation of the controller 360 (and hence the power supply 500C) if an over-voltage condition exists. In these respects, it should be appreciated that the over-voltage protection circuit 160 does not provide feedback associated with the load to the controller 360 so as to facilitate regulation of the output voltage 32 during normal operation of the apparatus; rather, the over-voltage protection circuit 160 functions only to shut down/prohibit operation of the power supply 500C if a load is not present disconnected, or otherwise fails to conduct current from the power supply (i.e., to cease normal operation of the apparatus entirely).

As indicated in Table 2 below, the power supply 500C of FIG. 10 may be configured for a variety of different input voltages, based on an appropriate selection of various circuit components.

TABLE 2

| A.C. Input Voltage | R4 | R5 | R10 | R11 |
|---|---|---|---|---|
| 120 V | 750K | 750K | 10K 1% | 20.0K 1% |
| 220 V | 1.5M | 1.5M | 2.49K 1% | 18.2K 1% |
| 100 V | 750K | 750K | 2.49K 1% | 10.0K 1% |

TABLE 2-continued

| A.C. Input Voltage | R4 | R5 | R10 | R11 |
|---|---|---|---|---|
| 120 V | 750K | 750K | 3.90K 1% | 20.0K 1% |
| 220 V | 1.5M | 1.5M | 2.49K 1% | 18.2K 1% |
| 100 V | 750K | 750K | 2.49K 1% | 10.0K 1% |

Figure 11:
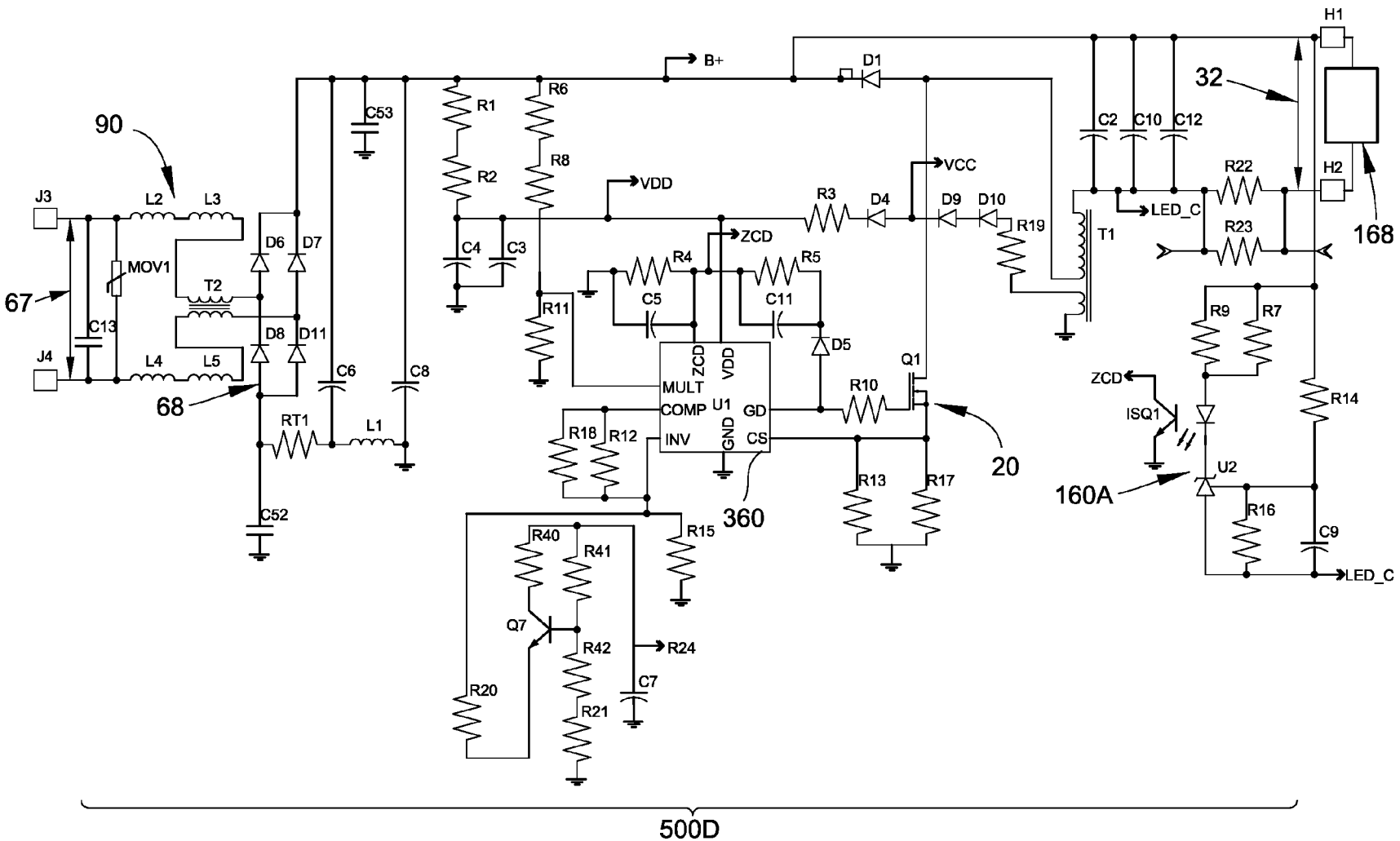

FIG. 11 is a schematic diagram of a power supply 500D based on the buck converter topology discussed above in connection with FIG. 8, but with some additional features relating to over-voltage protection and reducing electromagnetic radiation emitted by the power supply. These emissions can occur both by radiation into the atmosphere and by conduction into wires carrying the A.C. input voltage 67.

In some exemplary implementations, the power supply 500D is configured to meet Class B standards for electromagnetic emissions set in the United States by the Federal Communications Commission and/or to meet standards set in the European Community for electromagnetic emissions from lighting fixtures, as set forth in the British Standards document entitled "Limits and Methods of Measurement of Radio Disturbance Characteristics of Electrical Lighting and Similar Equipment," EN 55015:2001, Incorporating Amendments Nos. 1, 2 and Corrigendum No. 1, the entire contents of which are hereby incorporated by reference. For example, in one implementation, the power supply 500D includes an electromagnetic emissions ("EMI") filter circuit 90 having various components coupled to the bridge rectifier 68. In one aspect, the EMI filter circuit is configured to fit within a very limited space in a cost-effective manner; it is also compatible with conventional A.C. dimmers, so that the overall capacitance is at a low enough level to avoid flickering of light generated by LED light sources 168. The values for the components of the EMI filter circuit 90 in one exemplary implementation are given in the table below:

| Component | Characteristics |
|---|---|
| C13 | 0.15 μF; 250/275 VAC |
| C52, C53 | 2200 pF; 250 VAC |
| C6, C8 | 0.12 μF; 630 V |
| L1 | Magnetic inductor; 1 mH; 0.20 A |
| L2, L3, L4, L5 | Magnetic ferrite inductor; 200 mA; 2700 ohm; 100 MHz; SM 0805 |
| T2 | Magnetic, choke transformer; common mode; 16.5 MH PC MNT |

As further illustrated in FIG. 11 (as indicated at power supply connection "H3" to a local ground "F"), in another aspect the power supply 500D includes a shield connection, which also reduces the frequency noise of the power supply. In particular, in addition to the two electrical connections between the positive and negative potentials of the output voltage 32 and the load, a third connection is provided between the power supply and the load. For example, in one implementation, an LED PCB 335 (see FIG. 3B) may include several conductive layers that are electrically isolated from one another. One of these layers, which includes the LED light sources, may be the top-most layer and receive the cathodic connection (to the negative potential of the output voltage). Another of these layers may lie beneath the LED layer and receives the anodic connection (to the positive potential of the output voltage). A third "shield" layer may lie beneath the anodic layer and may be connected to the shield connector. During the operation of the lighting apparatus, the shield layer functions to reduce/eliminate capacitive coupling to the LED layer and thereby suppresses frequency noise. In yet another aspect of the apparatus shown in FIG. 11 and as indicated on the circuit diagram at the ground connection to C52, the EMI filter circuit 90 has a connection to a safety ground, which may provided via a conductive finger clip to a housing of the apparatus (rather than by a wire connected by screws), which allows for a more compact, easy to assemble configuration than conventional wire ground connections.

In yet other aspects shown in FIG. 11, the power supply 500D includes various circuitry to protect against an over-voltage condition for the output voltage 32. In particular, in one exemplary implementation output capacitors C2 and C10 may be specified for a maximum voltage rating of approximately 60 Volts (e.g., 63 Volts), based on an expected range of output voltages of approximately 50 Volts or lower. As discussed above in connection with FIG. 10, in the absence of any load on the power supply, or malfunction of a load leading to no current being drawn from the power supply, the output voltage 32 would rise and exceed the voltage rating of the output capacitors, leading to possible destruction. To mitigate this situation, the power supply 500D includes an over-voltage protection circuit 160A, including an optoisolator ISO 1 having an output that, when activated, couples the ZCD (zero current detect) input of the controller 360 (i.e., pin 5 of U1) to local ground "F". Various component values of the over-voltage protection circuit 160A are selected such that a ground present on the ZCD input terminates operation of the controller 360 when the output voltage 32 reaches about 50 Volts. As also discussed above in connection with FIG. 10, again it should be appreciated that the over-voltage protection circuit 160A does not provide feedback associated with the load to the controller 360 so as to facilitate regulation of the output voltage 32 during normal operation of the apparatus; rather, the over-voltage protection circuit 160A functions only to shut down/prohibit operation of the power supply 500D if a load is not present, disconnected, or otherwise fails to conduct current from the power supply (i.e., to cease normal operation of the apparatus entirely).

FIG. 11 also shows that the current path to the load 168 includes current sensing resistors R22 and R23, coupled to test points TPOINT1 and TPOINT2. These test points are not used to provide any feedback to the controller 360 or any other component of the power supply 500D. Rather, the test points TPOINT1 and TPOINT2 provide access points for a test technician to measure load current during the manufacturing and assembly process and, with measurements of load voltage, determine whether or not the load power falls within a prescribed manufacturer's specification for the apparatus.

As indicated in Table 3 below, the power supply 500D of FIG. 11 may be configured for a variety of different input voltages, based on an appropriate selection of various circuit components.

TABLE 3

| A.C. Input Voltage | R6 | R8 | R1 | R2 | R4 | R18 | R17 | R10 | C13 |
|---|---|---|---|---|---|---|---|---|---|
| 100 V | 750K 1% | 750K 1% | 150K | 150K | 24.0K 1% | 21.0K 1% | 2.00 1% | 22 | 0.15 μF |
| 120 V | 750K 1% | 750K 1% | 150K | 150K | 24.0K 1% | 12.4K 1% | 2.00 1% | 22 | 0.15 μF |
| 230 V | 1.5 M 1% | 1.5 M 1% | 300K | 300K | 27.0K 1% | 24.0K 1% | OMIT | 10 | 0.15 μF |
| 277 V | 1.5 M 1% | 1.5 M 1% | 300K | 300K | 27.0K 1% | 10K 1% | OMIT | 10 | OMIT |

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A lighting apparatus, comprising:

at least one LED light source;

a heat sink thermally coupled to the at least one LED light source;

a first housing portion mechanically coupled to the heat sink; and a second housing portion mechanically coupled to the heat sink, wherein:

the first housing portion is disposed with respect to the heat sink so as to form (i) a first air gap, (ii) a second air gap and (iii) an air channel through the lighting apparatus such that, when the heat sink transfers heat from the at least one LED light source during operation of the at least one LED light source so as to create heated air surrounding the heat sink, ambient air is drawn through the first air gap and the heated air is exhausted through the second air gap so as to create an air flow trajectory in the air channel from the first air gap to the second air gap.

2. The apparatus of claim 1, wherein the lighting apparatus is configured as a downlight fixture, wherein the second housing portion includes a mounting plate for mounting the downlight fixture to a surface, and wherein the first housing portion includes a bezel plate.

3. The apparatus of claim 2, further comprising a cover lens, disposed within a cavity formed by the bezel plate, for covering the at least one LED light source.

4. The apparatus of claim 1, wherein the heat sink is formed such that a majority of a surface area of the heat sink is disposed along the air channel between the first air gap and the second air gap.

5. The apparatus of claim 1, wherein the heat sink comprises a plurality of heat-dissipating fins.

6. The apparatus of claim 5, wherein the second housing portion includes a mounting plate for mounting the apparatus to a surface, and wherein the first housing portion includes a bezel plate.

7. The apparatus of claim 1, wherein the air channel substantially surrounds a perimeter of the at least one LED light source.

8. The apparatus of claim 7, wherein, when the lighting apparatus is mounted to the surface, the heat sink is disposed vertically above the light source and the air flow trajectory is primarily in an upward direction.

9. The apparatus of claim 8, wherein the apparatus further includes a power supply, wherein the heat sink includes a first recess on a first side of the heat sink for receiving the at least one LED light source, and wherein the heat sink further includes a second recess on a second side opposite the first side for receiving the power supply.

10. The apparatus of claim 1, wherein the at least one LED light source comprises:

a plurality of LEDs disposed on a printed circuit board; and a plurality of reflector optics disposed so as to receive light generated by the plurality of LEDs, wherein the plurality of reflector optics is coupled to the printed circuit board without using an adhesive.

11. A lighting fixture, comprising:

a bezel plate including an opening through which light passes, when generated by the fixture;

an LED module including at least one LED for generating the light; and a heat dissipating frame mechanically coupled to the bezel plate and including a mounting portion positioned within the opening of the bezel plate, the LED module being disposed on the mounting portion of the heat dissipating frame, wherein the bezel plate and the heat dissipating frame are positioned with respect to each other so as to form an air channel through the fixture, such that an air flow is created in the air channel via a chimney effect in response to heat generated by the LED module; and wherein the LED module comprises:

a printed circuit board;

a plurality of LEDs coupled to the printed circuit board;

a thermal gap pad for providing a thermal connection and electrical isolation between the printed circuit board and the mounting portion of the heat dissipating frame; and an optical assembly coupled to the printed circuit board for collimating the light generated by the LED module.

12. The fixture of claim 11, wherein at least a portion of the bezel plate constitutes a front face of the lighting fixture when the lighting fixture is mounted to a surface, and wherein the bezel plate and the heat dissipating frame are positioned with respect to each other so as to form an inlet air gap in the front face of the lighting fixture to allow ambient air to be drawn into the air channel via the chimney effect.

13. The fixture of claim 12, wherein the bezel plate and the heat dissipating frame are positioned with respect to each other so as to form an outlet air gap such that, when the lighting fixture is mounted to the surface, the outlet air gap is proximate to the surface to allow effluent air to be exhausted out of the air channel via the chimney effect.

14. The fixture of claim 11, wherein the optical assembly is coupled to the printed circuit board without using an adhesive.

15. The fixture of claim 14, wherein the mounting portion of the heat dissipating frame includes a first recess within which the LED module is disposed.

16. The fixture of claim 11, wherein the plurality of LEDs includes at least one white LED.

17. The fixture of claim 11, wherein the LED module is coupled to the mounting portion of the heat dissipating frame without using an adhesive.

18. A lighting fixture, comprising:

a bezel plate including an opening through which light passes, when generated by the fixture;

an LED module including at least one LED for generating the light; and a heat dissipating frame mechanically coupled to the bezel plate and including a mounting portion positioned within the opening of the bezel plate, the LED module being disposed on the mounting portion of the heat dissipating frame, wherein the bezel plate and the heat dissipating frame are positioned with respect to each other so as to form an air channel through the fixture, such that an air flow is created in the air channel via a chimney effect in response to heat generated by the LED module; and wherein the mounting portion of the heat dissipating frame includes a first recess within which the LED module is disposed, wherein the heat dissipating frame includes a second recess on an opposing side of the first recess, and wherein the fixture further comprises a power/control module disposed within the second recess.

19. The fixture of claim 18, wherein the power/control module includes a switching power supply for providing power factor correction and an output voltage to the LED module via control of a single switch, without requiring any feedback information associated with the at least one LED.

20. The fixture of claim 19, wherein the switching power supply includes at least one controller coupled to the single switch, the at least one controller controlling the single switch using a fixed off time (FOT) control technique.

21. The fixture of claim 19, wherein the output voltage and/or the power provided to the at least one LED is significantly variable only in response to variations in an RMS value of an A.C. input voltage applied to the power supply.

22. The fixture of claim 19, wherein the switching power supply comprises a boost converter configuration including an over-voltage protection circuit for shutting down the switching power supply if the output voltage exceeds a predetermined value.

23. The fixture of claim 19, wherein the power/control module further includes an A.C. dimmer for varying an RMS value of an A.C. input voltage applied to the power supply, wherein the output voltage to the at least one LED-based light source varies based at least in part on the RMS value of the A.C. input voltage.

* * * * *